US007268756B2

(12) United States Patent
Koyama et al.

(10) Patent No.: US 7,268,756 B2
(45) Date of Patent: Sep. 11, 2007

(54) LIQUID CRYSTAL DISPLAY DEVICE AND METHOD OF DRIVING A LIQUID CRYSTAL DISPLAY DEVICE

(75) Inventors: Jun Koyama, Kanagawa (JP); Yutaka Shionoiri, Kanagawa (JP); Hiroyuki Miyake, Kanagawa (JP); Yasuhiro Hirayama, Osaka (JP); Buyeol Lee, Nara (JP)

(73) Assignees: Semiconductor Energy Laboratory Co., Ltd., Kanagawa-ken (JP); Sharp Kabushiki Kaisha, Osaka (JP)

( * ) Notice: Subject to any disclaimer, the term of this patent is extended or adjusted under 35 U.S.C. 154(b) by 421 days.

(21) Appl. No.: 10/650,930

(22) Filed: Aug. 29, 2003

(65) Prior Publication Data

US 2004/0041764 A1 Mar. 4, 2004

(30) Foreign Application Priority Data

Sep. 2, 2002 (JP) ..... 2002-257210

(51) Int. Cl.
*G09G 3/36* (2006.01)

(52) U.S. Cl. ..... 345/87; 345/98; 345/100

(58) Field of Classification Search ..... 345/87–89, 345/98–100, 211–213
See application file for complete search history.

(56) References Cited

U.S. PATENT DOCUMENTS 6,049,321 A 4/2000 Sasaki
6,424,328 B1 7/2002 Ino
6,486,497 B2 11/2002 Misawa et al.
6,784,865 B2 8/2004 Akimoto
6,909,411 B1 * 6/2005 Yamazaki et al. ..... 345/87
2001/0045932 A1 11/2001 Mukao
2002/0063674 A1 * 5/2002 Chiang ..... 345/98
2002/0089485 A1 * 7/2002 Youn ..... 345/99
2003/0006979 A1 1/2003 Tsuchi
2003/0085865 A1 * 5/2003 Lee et al. ..... 345/98
2004/0041765 A1 3/2004 Koyama

FOREIGN PATENT DOCUMENTS

JP 62-143095 6/1987
JP 01-289917 11/1989

OTHER PUBLICATIONS

Jun Koyama et al.; "Liquid Crystal Display Device and Method of Driving a Liquid Crystal Display Device"; Country Equivalent Application filed Aug. 29, 2003; pp. 1-34 and 17 sheets of drawings—This application claims priority to Japan 2002-257209, filed Sep. 2, 2002.

* cited by examiner

*Primary Examiner*—Richard Hjerpe
*Assistant Examiner*—Kimnhung Nguyen
(74) *Attorney, Agent, or Firm*—Fish & Richardson P.C.

(57) ABSTRACT

A liquid crystal display device having analog buffer circuits, which is reduced in luminance fluctuation is provided. A source signal line driver circuit has a plurality of analog buffer circuits, the plurality of source signal lines and the plurality of analog buffer circuits constitute a circuit group, and source signal lines connected to the analog buffer circuits are switched their connections to different analog buffer circuits each time a new period is started. Therefore, output fluctuation among the analog buffer circuits is averaged and a uniform image can be displayed on the screen.

60 Claims, 17 Drawing Sheets

LIQUID CRYSTAL DISPLAY DEVICE AND METHOD OF DRIVING A LIQUID CRYSTAL DISPLAY DEVICE

BACKGROUND OF THE INVENTION

1. Field of the Invention

The present invention relates to a display device, and more particularly to an liquid crystal display device using thin film transistors (TFTs) formed over a transparent substrate made of glass, plastic, or the like and a driving method thereof. In addition, the present invention relates to electronic equipment using a liquid crystal display device.

2. Description of the Related Art

In recent years, mobile telephones have become widespread due to development of communication technology. In future, moving picture transmission and a larger amount of information transfer are further expected. With respect to a personal computer, products for mobile applications are manufactured due to a reduction in weight thereof. A large number of information terminals called PDAs starting with electronic notebooks are also manufactured and becoming widespread. In addition, with the development of display devices and the like, most of portable information devices are equipped with a flat panel display.

According to recent techniques, an active matrix display device tends to be used as a display device used therefor. In the active matrix display device, a TFT is arranged in each pixel and a screen is controlled by the TFTs. Compared to a passive matrix display device, such an active matrix display device has advantages in that it achieves high performance and high image quality and can handle moving pictures. Thus, it is considered that mainstream liquid crystal display devices will also change from passive matrix types to active matrix types.

Also, in active matrix display devices, in recent years, commercialization of a display device using low temperature polysilicon is progressing. With low temperature polysilicon, not only portion, and as miniaturization and high definition of the display device is possible, it i the pixels but also the driver circuit can be integrally formed on the periphery of the pixel s expected that the display device using low temperature polysilicon will become even more widespread.

A description is given below on the operation of a pixel portion in an active matrix liquid crystal display device. FIG. 3 shows an example of the structure of an active matrix liquid crystal display device. One pixel 302 is composed of a source signal line S1, a gate signal line G1, a capacitance line C1, a pixel TFT 303, and storage capacitor 304. The capacitance line is not always necessary if other wire can double as the capacitance line. A gate electrode of the pixel TFT 303 is connected to the gate signal line G1. One of a drain region and a source region of the pixel TFT 303 is connected to the source signal line S1 whereas the other is connected to the storage capacitor 304 and a pixel electrode 305.

Gate signal lines are selected sequentially in accordance with line cycle. If the pixel TFT is an n-channel TFT, the gate signal line becomes active when it is Hi, then the pixel TFT turns ON. As the pixel TFT is turned ON, the electric potential of the source signal line is written in the storage capacitor and in a liquid crystal. In the next line period, the adjacent gate signal line becomes active and the electric potential of the source signal line is written in the storage capacitor and the liquid crystal in a similar fashion. (Reference 1: Laid-open No. 1-289917)

Described next is the operation of a source line driver circuit. FIG. 2 shows an example of a conventional source signal line driver circuit, which is an example of the source signal line driver circuit that drives analog type dot sequential system. In this example, the source signal line driver circuit is composed of a shift register 201, a NAND circuit 207, a buffer circuit 208, and an analog switch 209. First, a source start pulse SSP is inputted to the first stage of the shift register through a switch 206. The switch 206 determines the scanning direction of the shift register. Scanning is made from left to right in FIG. 2 when SLR is Lo and from right to left when SL/R is Hi. A DFF 202 constitutes each stage of the shift register. The DFF 202 is composed of clocked inverters 203 and 204 and an inverter 205, and shifts pulses each time clock pulses CL and CLb are inputted.

Output of the shift register is inputted to the buffer circuit 208 through the NAND circuit 207. Output of the buffer circuit turns the analog switches 209 to 212 ON for sampling of video signals directed to source signal lines S1 to S4.

A middle-sized or small-sized liquid crystal panel can be operated by the dot sequential driving described above. However, in a large-sized liquid crystal panel, dot sequential driving cannot provide sufficient time for writing of source signal lines because the wire capacitance of the source signal lines is about 100 pF and delay time of the source signal lines themselves is too great. Then, it becomes impossible to perform writing. Therefore, a large-sized panel needs linear sequential driving in which data is temporarily stored in a memory within the source signal line driver circuit and then written in a source signal line during the next one line period.

Such linear sequential driving needs analog buffer circuits placed downstream of the memory. An example of a source signal line driver circuit adaptable to linear sequential driving is shown in FIG. 4. Analog switches 401 to 404 operate in the same way as the analog switches do in the dot sequential source signal line driver circuit shown in FIG. 2. Unlike FIG. 2 where the analog switches drive source signal lines, the analog switches 401 to 404 drive capacitors 405 to 408, which serve as analog memories. As one line of data are sequentially stored in the analog memories, TRN and TRNb signals become active in the next retrace period to turn analog switches 409 to 412 ON. This starts transfer of the data in the analog memories 405 to 408 to analog memory capacitors 413 to 416.

Then, the analog switches 409 to 412 are turned OFF before the analog switches 401 to 404 are turned ON in preparation for the next sampling. The data in the analog memories 413 to 416 are outputted to source signal lines S1 to S4 through the analog buffer circuits 417 to 420. The data in the analog memories 413 to 416 are kept for one line period and therefore the analog buffer circuits 417 to 420 are allowed to take one line period to charge the source lines. In this way, linear sequential driving in a large-sized panel is made possible by analog memories and analog buffer circuits. (Reference 2: Laid-open No. 62-143095)

However, when analog buffer circuits in a large-sized panel are constituted of TFTs, fluctuation among the analog buffer circuits is a problem. Fluctuation among the analog buffer circuits causes output fluctuation even though video signals of the same gradation are inputted. As a result, vertical streaks appear on the screen lowering the image quality considerably.

When low temperature polysilicon is used to manufacture a liquid crystal display device, a driver circuit is integrally formed. However, transistors of this driver circuit are more fluctuated than those of a driver circuit that is formed of single crystal silicon. This is supposedly due to uneven crystallization and damage by electrostatic during the process. When a driver circuit is formed taking into consideration such fluctuation, the fluctuation is more obvious in a component that conducts analog operation, in particular, analog buffer circuits, than in the logic portion.

In the conventional source signal line driver circuit shown in FIG. 4, a voltage difference between the output voltage of each analog buffer circuit and the average of output of plural analog buffer circuits is considered. A voltage difference between the mean output value and an analog buffer circuit output A is given as ΔVA. Similarly, voltage differences between the mean output value and analog buffer circuit outputs B, C, and D are given as ΔVB, ΔVC, and ΔVD, respectively. When ΔVA is +100 mV, ΔVB is −100 mV, ΔVC is −50 mV, and ΔVD is +30 mV, the difference between the source signal lines S2 and S3 is 50 mV whereas the difference between the source signal lines S1 and S2 is 200 mV, which is large enough for human eyes to recognize the gradation difference.

SUMMARY OF THE INVENTION

The present invention has been made to solve the above problems, and an object of the present invention is therefore to provide a liquid crystal display device which is reduced in luminance fluctuation. Another object of present invention is to provide a switching means by interposing switching circuit between analog buffer circuits and source signal lines to switch outputs. Consequently, output fluctuation among the analog buffer circuits is time-averaged, and display unevenness is thus made inconspicuous.

The structure of the present invention is shown below.

The present invention relates to a liquid crystal display device having on an insulating substrate a plurality of source signal lines, a plurality of gate signal lines, a plurality of pixels, and a source signal line driver circuit for driving the source signal lines, characterized in that: the source signal line driver circuit has a plurality of analog buffer circuits; a switching means is provided between the analog buffer circuits and the source signal lines; the plurality of source signal lines and the plurality of analog buffer circuits constitute a circuit group; and that the source signal lines in the circuit group connected to analog buffer circuits in the circuit are periodically switched by the switching means their connections to different circuits.

The present invention relates to a liquid crystal display device having on an insulating substrate a plurality of source signal lines, a plurality of gate signal lines, a plurality of pixels, and a source signal line driver circuit for driving the source signal lines, characterized in that: the source signal line driver circuit has a plurality of analog buffer circuits; a switching means is provided between the analog buffer circuits and the source signal lines; the plurality of source signal lines and the plurality of analog buffer circuits constitute a circuit group; and that the source signal lines in the circuit group connected to analog buffer circuits in the circuit are switched in a random timing by the switching means their connections to different circuits.

The present invention relates to a liquid crystal display device having on an insulating substrate a plurality of pixels, a plurality of source signal lines, a plurality of gate signal lines, and a source signal line driver circuit, the source signal line driver circuit having a plurality of analog buffer circuits to drive the source signal lines, characterized in that: a switching means is provided between the analog buffer circuits and the source signal lines; n (n is a natural number and is equal to or larger than 2) source signal lines and n analog buffer circuits constitute a circuit group, a set of n periods is periodically repeated; and that the source signal lines in the circuit group connected to analog buffer circuits in the circuit are switched in every period by the switching means their connections to different circuits.

The present invention relates to a liquid crystal display device having on an insulating substrate a plurality of pixels, a plurality of source signal lines, a plurality of gate signal lines, and a source signal line driver circuit, the source signal line driver circuit having a plurality of analog buffer circuits to drive the source signal lines, characterized in that: a switching means is provided between the analog buffer circuits and the source signal lines; n (n is a natural number and is equal to or larger than 2) source signal lines and n analog buffer circuits constitute a circuit group; a set of n periods is repeated in a random timing; and the source signal lines in the circuit group connected to analog buffer circuits in the circuit are switched in every period by the switching means their connections to different circuits.

The present invention relates to a liquid crystal display device having on an insulating substrate a plurality of pixels, a plurality of source signal lines, a plurality of gate signal lines, and a source signal line driver circuit, the source signal line driver circuit having analog buffer circuits to drive the source signal lines, characterized in that: a switching means is provided between the analog buffer circuits and the source signal lines; n (n is a natural number and is equal to or larger than 2) source signal lines and n analog buffer circuits constitute a circuit group; a set of n periods is periodically repeated; and that, in an r-th period (r is a natural number that satisfies $1 \leqq r \leqq n$), the switching means connects an m-th source signal line (m is a natural number that satisfies $1 \leqq m \leqq n-r+1$) in the circuit group to an (m+r−1)-th analog buffer circuit and an l-th source signal line (l is a natural number that satisfies $n-r+2 \leqq l \leqq n$) to an (l−n+r−1)-th analog buffer circuit, respectively.

The present invention relates to a liquid crystal display device having on an insulating substrate a plurality of pixels, a plurality of source signal lines, a plurality of gate signal lines, and a source signal line driver circuit, the source signal line driver circuit having analog buffer circuits to drive the source signal lines, characterized in that a switching means is provided between the analog buffer circuits and the source signal lines; n (n is a natural number and is equal to or larger than 2) source signal lines and n analog buffer circuits constitute a circuit group; a set of n periods is repeated in a random timing; and that, in an r-th period (r is a natural number that satisfies $1 \leqq r \leqq n$), the switching means connects an m-th source signal line (m is a natural number that satisfies $1 \leqq m \leqq n-r+1$) in the circuit group to an (m+r−1)-th analog buffer circuit and an 1-th source signal line (l is a natural number that satisfies $n-r+2 \leqq l \leqq n$) to an (l−n+r−1)-th analog buffer circuit, respectively.

In the above-mentioned structures of the present invention, the analog buffer circuits are source follower circuits or voltage follower circuits.

The present invention relates to a method of driving a liquid crystal display device having on an insulating substrate a plurality of source signal lines, a plurality of gate signal lines, a plurality of pixels, and a source signal line driver circuit for driving the source signal lines, characterized in that: the source signal line driver circuit has a plurality of analog buffer circuits; the plurality of source signal lines and the plurality of analog buffer circuits constitute a circuit group; and that the source signal lines in the circuit group are periodically driven by the different analog buffer circuits in the circuit group, respectively.

The present invention relates to a method of driving a liquid crystal display device having on an insulating substrate a plurality of source signal lines, a plurality of gate signal lines, a plurality of pixels, and a source signal line driver circuit for driving the source signal lines, characterized in that: the source signal line driver circuit has a plurality of analog buffer circuits; the plurality of source signal lines and the plurality of analog buffer circuits constitute a circuit group; and that the source signal lines in the circuit group are driven in a random timing by the different analog buffer circuits in the circuit group, respectively.

The present invention relates to a method of driving a liquid crystal display device having on an insulating substrate a plurality of pixels, a plurality of source signal lines, a plurality of gate signal lines, and a source signal line driver circuit, the source signal line driver circuit having a plurality of analog buffer circuits to drive the source signal lines, characterized in that: n (n is a natural number and is equal to or larger than 2) source signal lines and n analog buffer circuits constitute a circuit group; a set of n periods is periodically repeated; and that the source signal lines in the circuit group are driven in every period by the different analog buffer circuits in the circuit group, respectively.

The present invention relates to a method of driving a liquid crystal display device having on an insulating substrate a plurality of pixels, a plurality of source signal lines, a plurality of gate signal lines, and a source signal line driver circuit, the source signal line driver circuit having a plurality of analog buffer circuits to drive the source signal lines, characterized in that: n (n is a natural number and is equal to or larger than 2) source signal lines and n analog buffer circuits constitute a circuit group; a set of n periods is repeated in a random timing; and that the source signal lines in the circuit group are driven in every period by the different analog buffer circuits in the circuit group, respectively The present invention relates to a method of driving a liquid crystal display device having on an insulating substrate a plurality of pixels, a plurality of source signal lines, a plurality of gate signal lines, and a source signal line driver circuit, the source signal line driver circuit having analog buffer circuits to drive the source signal lines, characterized in that: n (n is a natural number and is equal to or larger than 2) source signal lines and n analog buffer circuits constitute a circuit group; a set of n periods is periodically repeated; and that, in an r-th period (r is a natural number that satisfies $1 \leqq r \leqq n$), an m-th source signal line (m is a natural number that satisfies $1 \leqq m \leqq n-r+1$) in the circuit group is driven by an (m+r−1)-th analog buffer circuit and an 1-th source signal line (l is a natural number that satisfies $n-r+2 \leqq l \leqq n$) is driven by an ($l \leqq n+r \leqq 1$)-th analog buffer circuit.

The present invention relates to a method of driving a liquid crystal display device having on an insulating substrate a plurality of pixels, a plurality of source signal lines, a plurality of gate signal lines, and a source signal line driver circuit, the source signal line driver circuit having analog buffer circuits to drive the source signal lines, characterized in that: n (n is a natural number and is equal to or larger than 2) source signal lines and n analog buffer circuits constitute a circuit group; a set of n periods is repeated in a random timing; and that, in an r-th period (r is a natural number that satisfies $1 \leqq r \leqq n$), an m-th source signal line (m is a natural number that satisfies $1 \leqq m \leqq n-r+1$) in the circuit group is driven by an (m+r−1)-th analog buffer circuit and an l-th source signal line (l is a natural number that satisfies $n-r+2 \leqq l \leqq n$) is driven by an (l−n+r−1)-th analog buffer circuit.

In the above-mentioned driving methods of the liquid crystal display according to the present invention, the method is characterized in that the analog buffer circuits are source follower circuits or voltage follower circuits.

Through the above structure and method, vertical streaks are prevented from being displayed on the screen even when analog buffer circuits built on an insulating substrate are fluctuated in output.

DETAILED DESCRIPTION OF THE PREFERRED EMBODIMENTS

Embodiment Mode

An embodiment mode of the present invention will be described in detail below with reference to the drawings.

Figure 1:
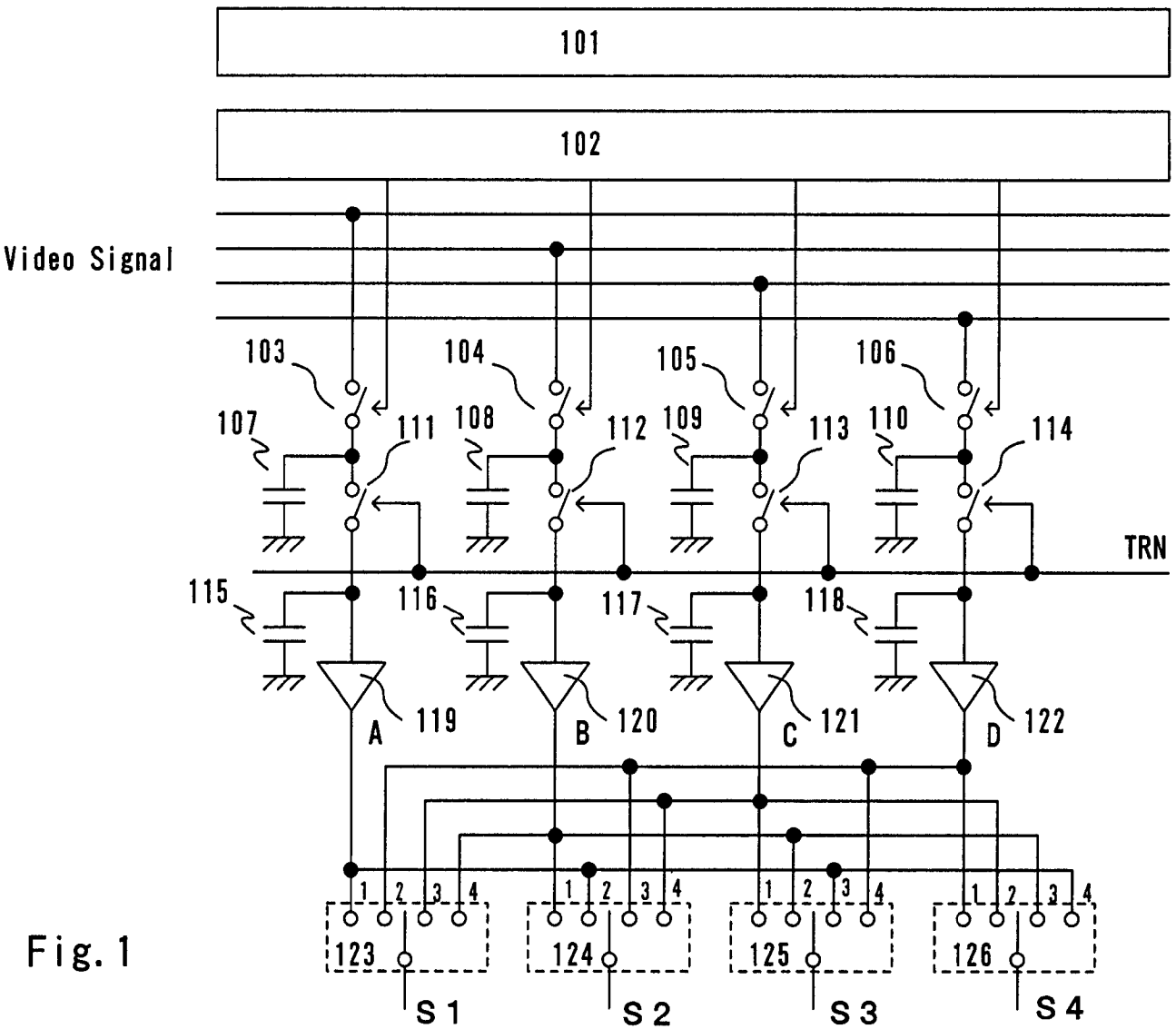
FIG. 1 is a block diagram of a source signal line driver circuit in a liquid crystal display device of the present invention.
Figure 2:
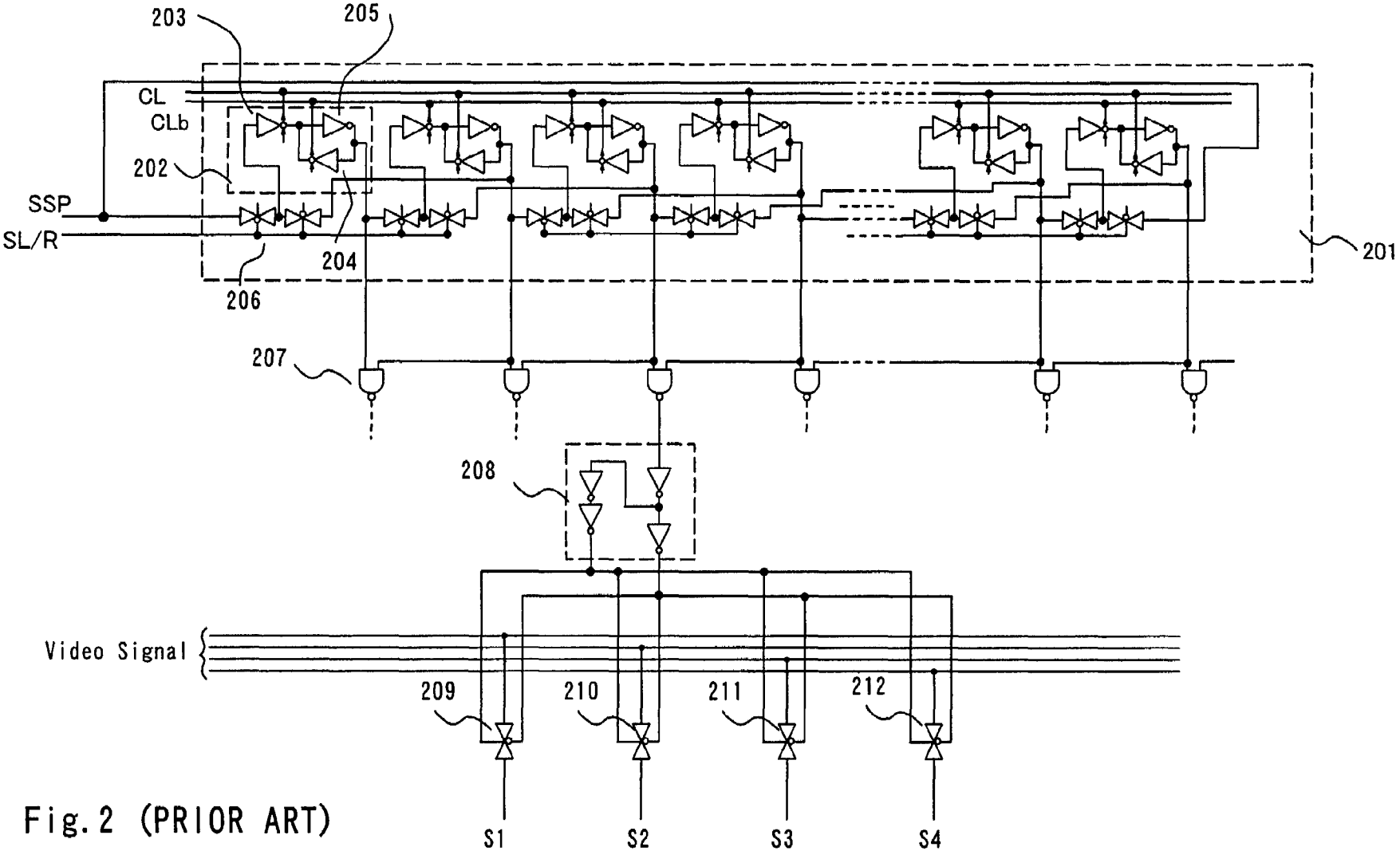
Fig. 2 (PRIOR ART)
FIG. 2 is a block diagram of a source signal line driver circuit in a conventional liquid crystal display device.
Figure 3:
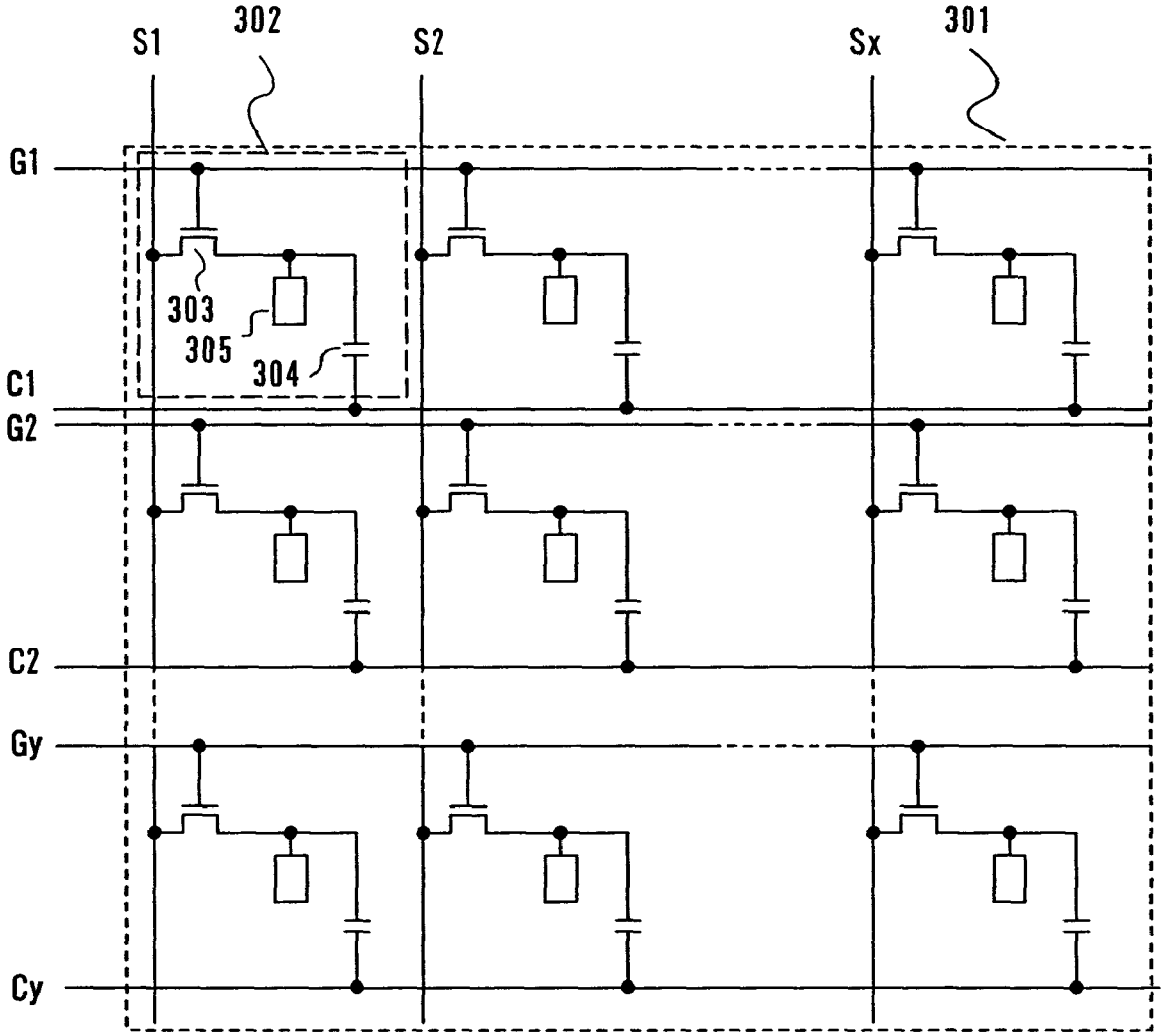
FIG. 3 is a diagram showing a structure of a pixel portion in the liquid crystal display device.
Figure 4:
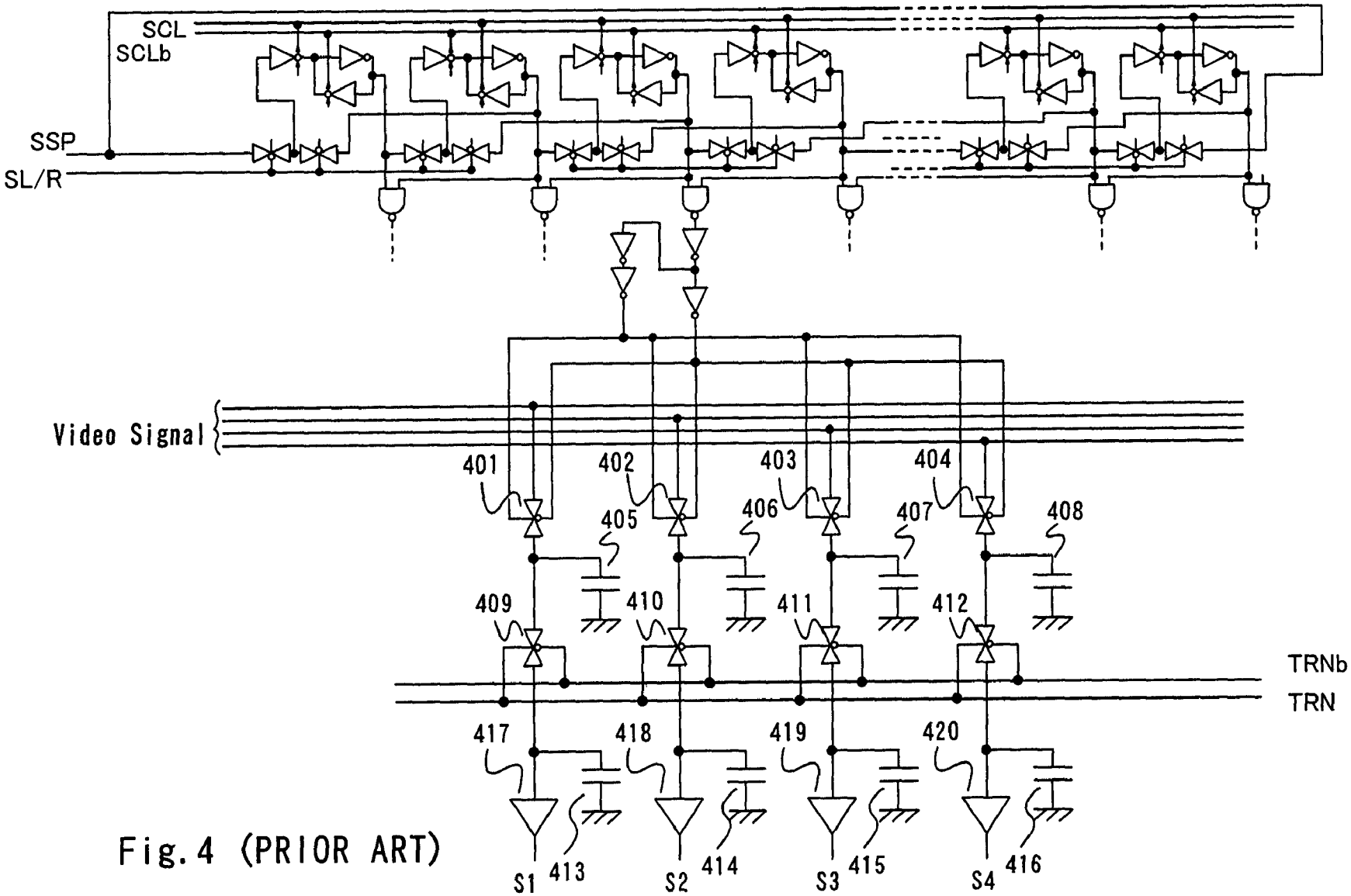
Fig. 4 (PRIOR ART)
FIG. 4 is a block diagram of the source signal line driver circuit in the conventional liquid crystal display device.

FIG. 1 shows a liquid crystal display device of the present invention. Its shift register and other components are similar to those explained in the prior art. The difference between the present invention and prior art is that the device of FIG. 1 has switches 123 to 126 between analog buffer circuits 119 to 122 and source signal lines S1 to S4. Now, the operation of the device of this embodiment mode is described. This description takes as an example a case of using four-contact point switches for the switches 123 to 126 as a switching means. However, the present invention is not limited to four-contact point switches and the number of contact points does not matter in carrying out the present invention.

In the present invention, connections of the switches 123 to 126 are switched from one to another. Here, the switching cycle is one frame but the present invention is not limited thereto. When source signal lines S1 to S4 and analog buffer circuits 119 to 122 constitute circuits groups respectively, the connection change therein will be described below. In the first frame, the switches 123 to 126 are in a "1" connection state where an output A of the is connected to a source signal line S1 whereas outputs B, C and D of the analog buffer circuits 120 to 122 are connected to source signal lines S2, S3 and S4 respectively.

Next, in the second frame, the switches 123 to 126 are in a "2" connection state where an output A of the analog buffer circuit 119 is connected to a source signal line S2 whereas outputs B, C and D of the analog buffer circuits 120 to 122 are connected to source signal lines S3, S4 and S1 respectively. In the third frame, the switches 123 to 126 are in a "3" connection state where an output A of the analog buffer circuit 119 is connected to a source signal line S3 whereas outputs B, C and D of the analog buffer circuits 120 to 122 are connected to source signal lines S4, S1 and S2 respectively.

Next, in the fourth frame, the switches 123 to 126 are in a "4" connection state where an output A of the analog buffer circuit 119 is connected to a source signal line S4 whereas outputs B, C and D of the analog buffer circuits 120 to 122 are connected to source signal lines S1, S2 and S3 respectively.

Next, in the fifth frame, the switches 123 to 126 are again in a "1" connection state where an output A of the analog buffer circuit 119 is connected to a source signal line S1 whereas outputs B, C and D of the analog buffer circuits 120 to 122 are connected to source signal lines S2, S3 and S4 respectively. In this way, the switches 123 to 126 repeat a connection change at a period of four frames. Specifically, the source signal line S1 to S4 and the analog buffer 120 to 122 constitute a circuit, and the source signal lines are changing their connection to different analog buffer circuit each time a new period is started.

Figure 10:
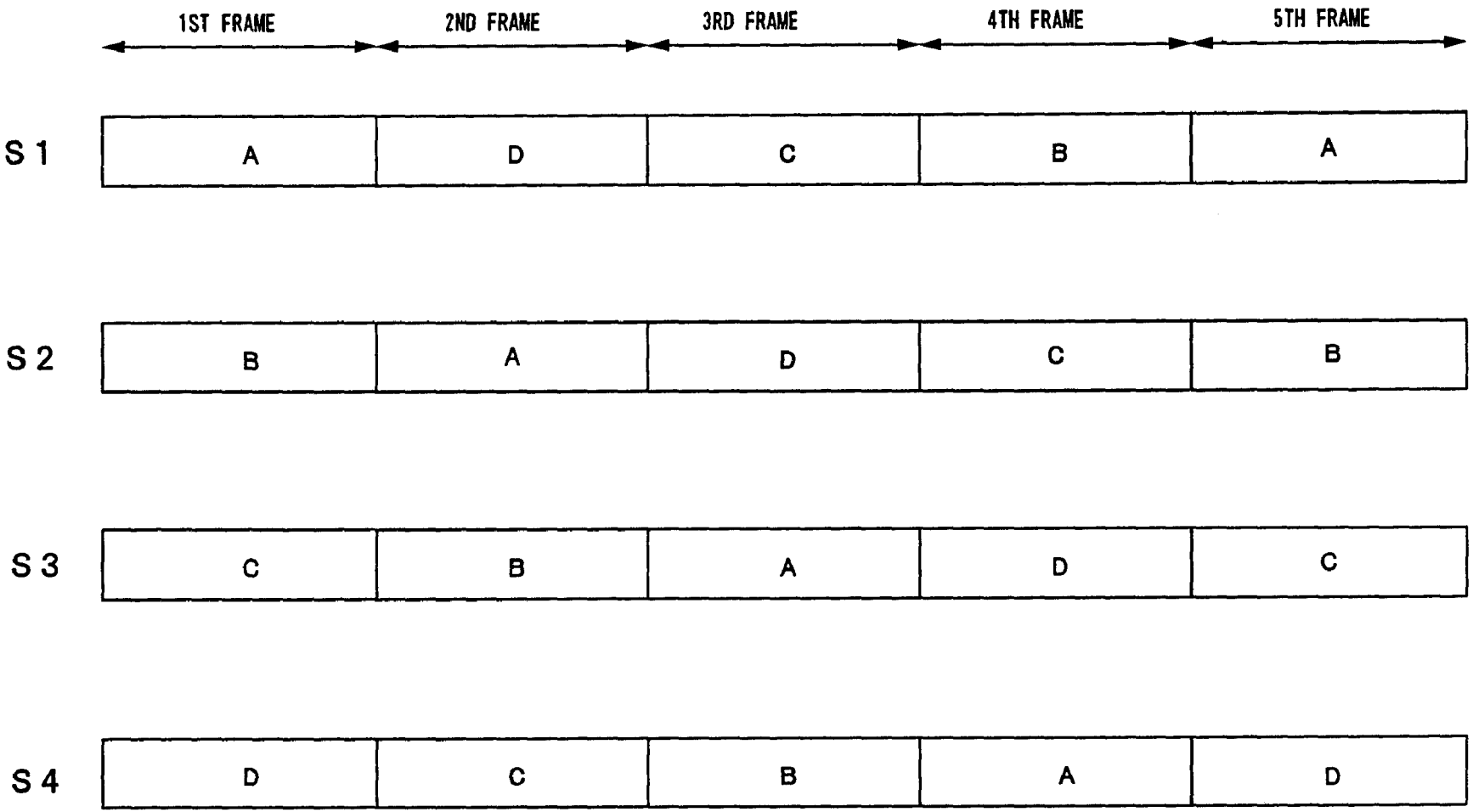
FIG. 10 is a diagram showing a connection between a source signal line and analog buffer circuits.

The switching is made in a four-frame cycle since four-contact point switches are employed. The cycle can be changed by changing the number of contact points as described above. It is also unnecessary to stick to a frame-based cycle. Any cycle will do as long as the fluctuation can be averaged apparently. FIG. 10 shows output of the analog buffer circuits each connected to a source signal line.

As in the prior art, a voltage difference between the output voltage of each analog buffer circuit and the average of output of plural analog buffer circuits is obtained. A voltage difference between the mean output value and the analog buffer circuit output A is given as ΔVA. Similarly, voltage differences between the mean output value and the analog buffer circuit outputs B, C, and D are given as ΔVB, ΔVC, and ΔVD, respectively. Then, the voltage differences seem averaged to human eyes. Accordingly, each of the source signal lines S1, S2, S3, and S4 is given an output electric potential difference of (ΔVA+ΔVB+ΔVC+ΔVD)/4.

When ΔVA is +100 mV, ΔVB is −100 mV, ΔVC is −50 mV, and ΔVD is +30 mV as in the prior art, the voltages of the source signal lines S1 to S4 are averaged and each are set to −5 mV. Therefore, the problem of the prior art, in which there is as large an electric potential difference as 200 mV between adjacent lines to make vertical streaks conspicuous, can be avoided.

In the above embodiment mode, the switches each have four contact points and a repeating cycle is composed of four periods. However, the number of periods is not limited to four. The objective effect can be obtained by setting n (n is a natural number and is equal to or larger than 2) periods, connecting an m-th in the circuit source signal line (m is a natural number that satisfies $1 \leqq m \leqq n-r+1$) to an (m+r−1)-th analog buffer (r is a natural number that satisfies $1 \leqq r < n$) and connecting an 1-th source signal line (l is a natural number that satisfies $n-r+2 \leqq l \leqq n$) to an (l−n+r−1)-th analog buffer circuit in an r-th period.

[Embodiment 1]

Figure 7:
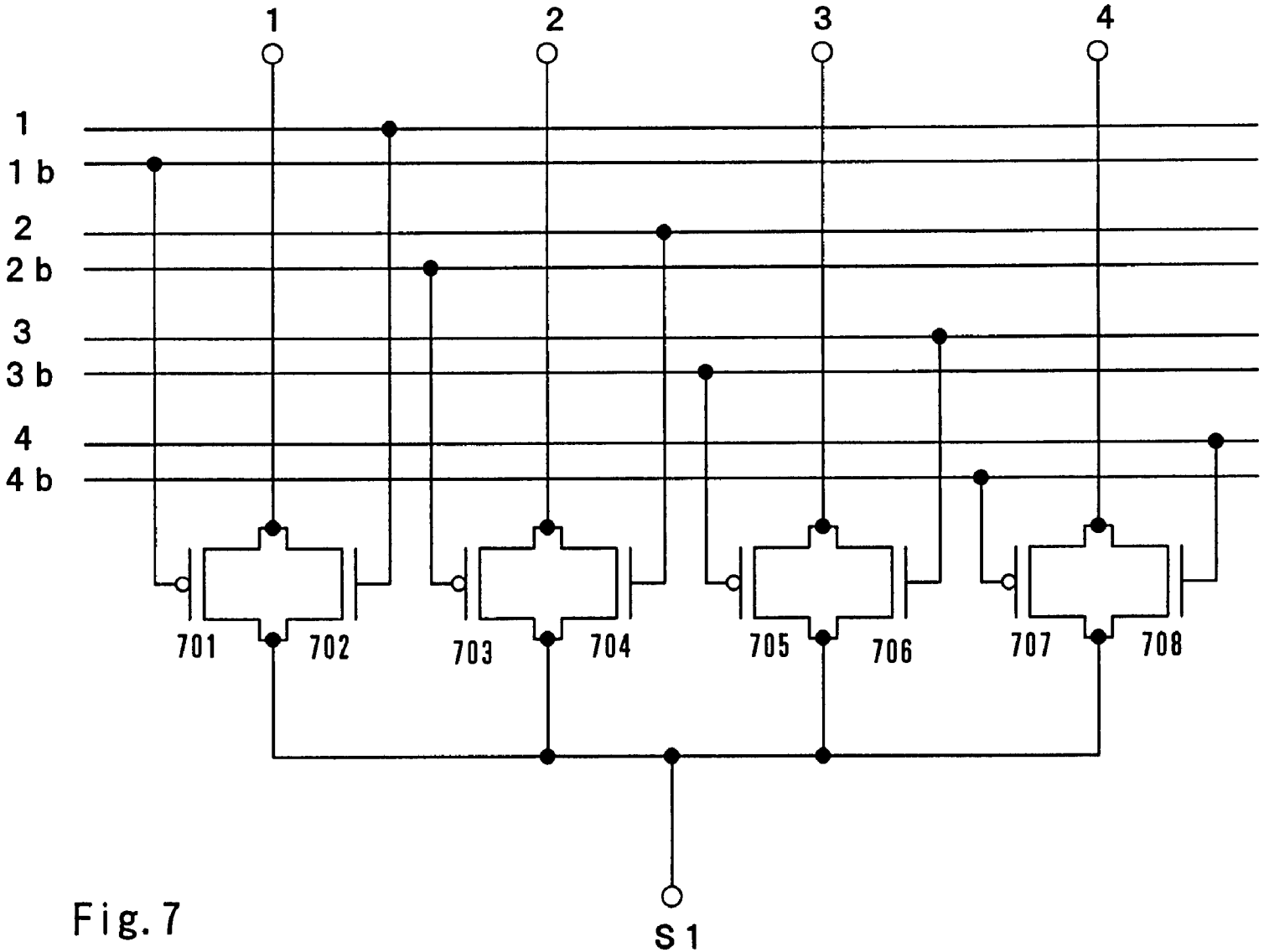
FIG. 7 is a circuit diagram of a switch of the present invention.
Figure 8:
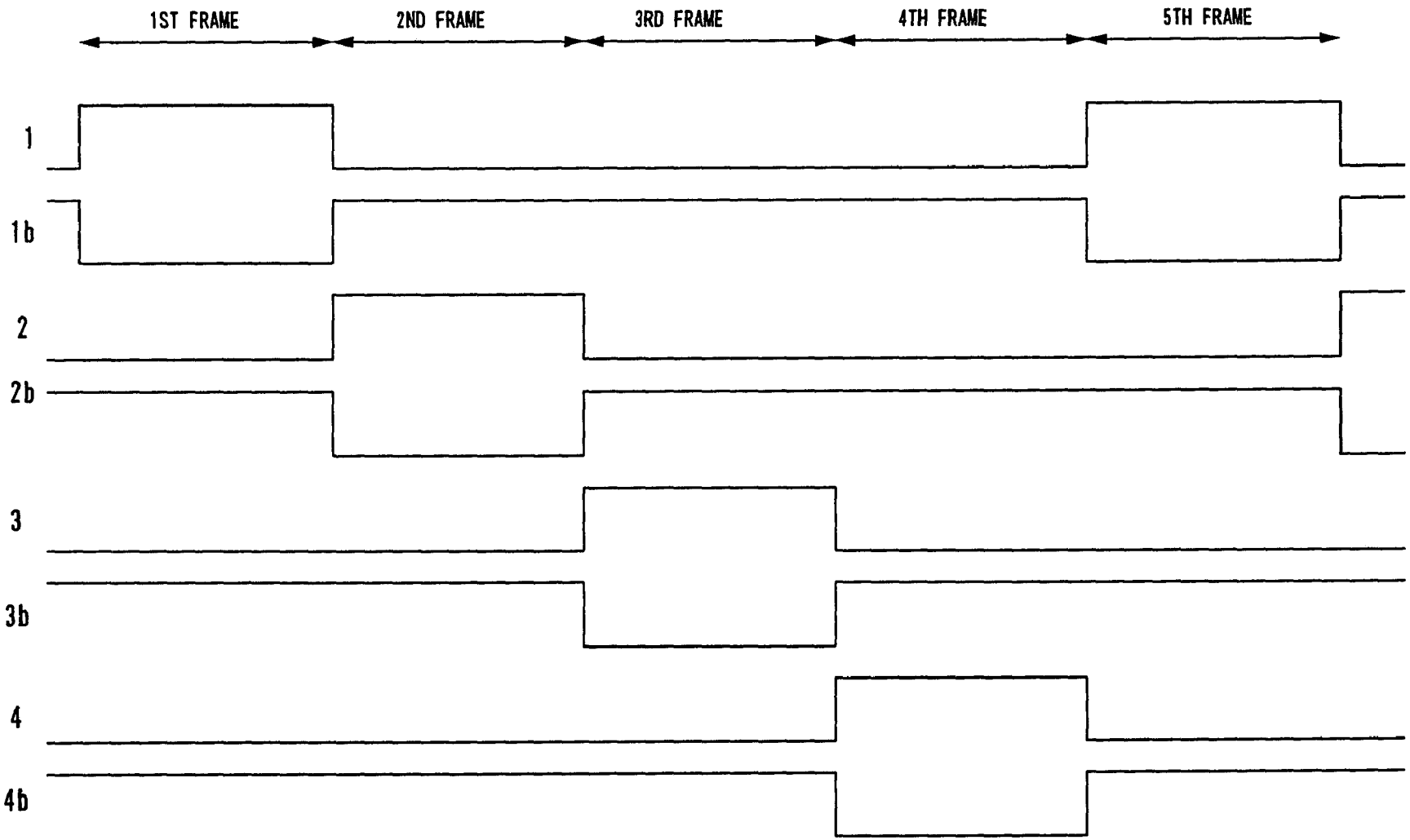
FIG. 8 is a timing chart of the switch of the present invention.

FIG. 7 shows Embodiment 1, which is a specific circuit example of the switch 123 of a switching means shown in FIG. 1. In this embodiment, analog switch circuits are used as the switching means. The switch is composed of TFTs 701 to 708 and is controlled by control lines 1, 1*b*, 2, 2*b*, . . . , and 4*b*, which are separately connected to gate terminals of the TFTs 701 to 708. FIG. 8 is a timing chart of the control lines 1 to 4*b*. Control signals shown in FIG. 8 connect A shown in FIG. 1, in FIG. 7 to source signal lines S1 to S4 during the first to fourth frame. The circuit diagram shown in FIG. 7 has a CMOS structure but may have an NMOS structure or a PMOS structure instead. In this case, the number of control lines is cut in half

[Embodiment 2]

Figure 5:
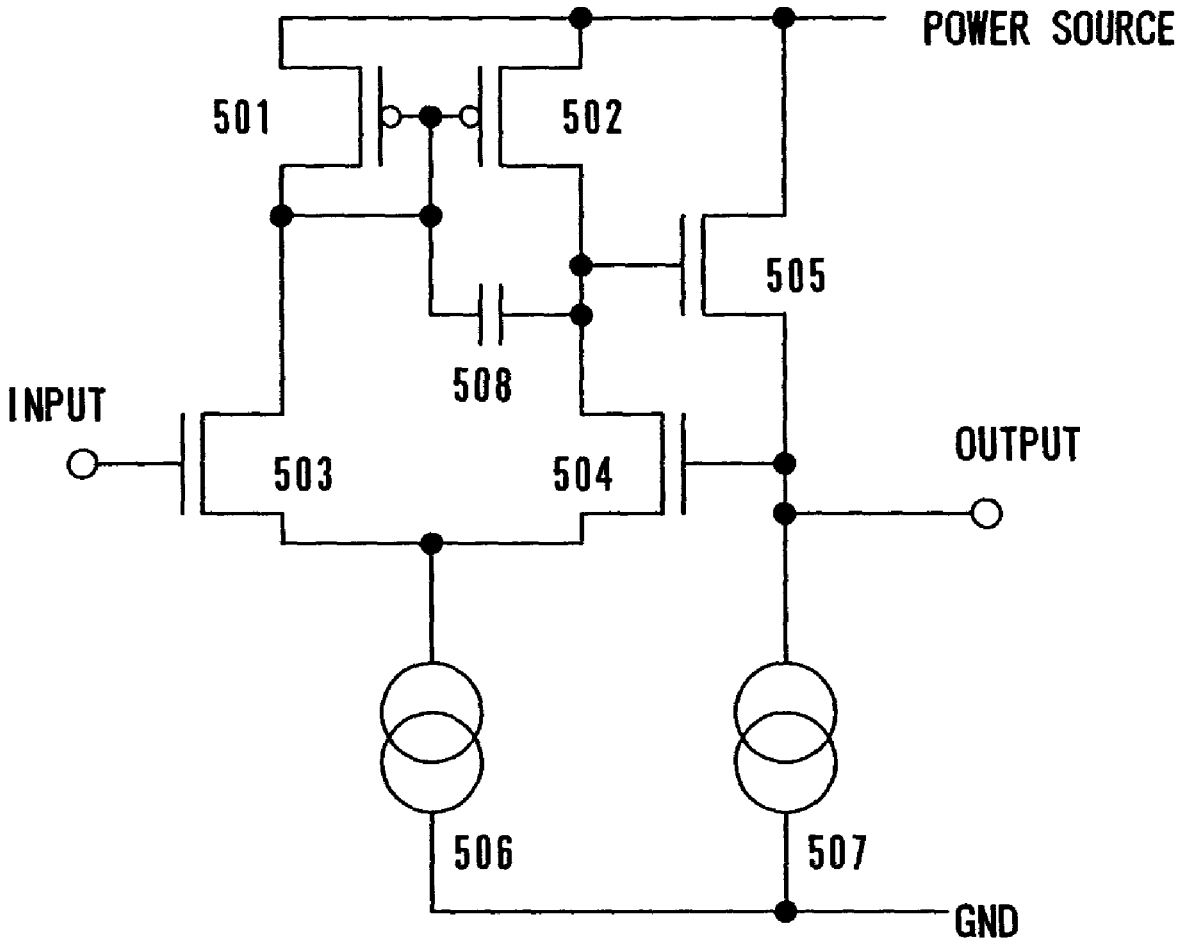
FIG. 5 is a circuit diagram of an operation amplifier type analog buffer.

FIG. 5 shows an operation amplifier circuit as an example of an analog buffer circuit. The output voltage fluctuation of this type of analog buffer circuit depends on fluctuation in characteristic between TFTs 503 and 504, which constitute a differential circuit, and fluctuation between TFTs 501 and 502, which constitute a current mirror circuit. If fluctuation between adjacent TFTs in a pair is small, the overall fluctuation of the panel can be large without causing a problem. For that reason, operation amplifier type analog buffer circuits are often used in integrated circuits.

In this example, the differential circuit is composed of n-channel TFTs and the current mirror circuit is composed of p-channel TFTs. However, the present invention is not limited thereto and the polarities of these circuits may be reversed. Also, the present invention is not limited to the circuit connection shown in this example and any circuit connection can be employed as long as it provides the function of an operation amplifier.

[Embodiment 3]

Figure 6:
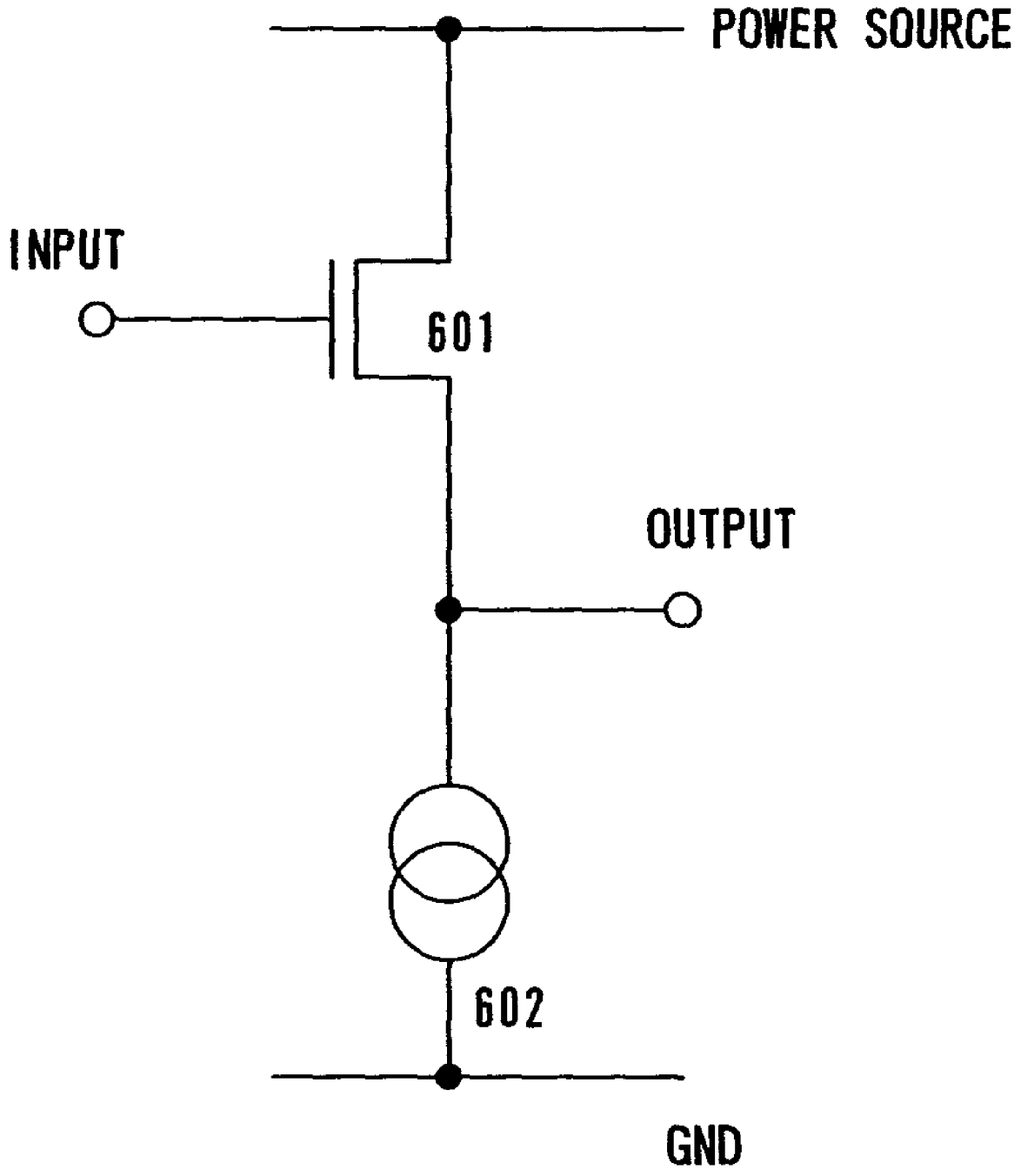
FIG. 6 is a circuit diagram of a source follower type analog buffer.

FIG. 6 shows a source follower circuit as an example of an analog buffer circuit. The source follower circuit is composed of a buffer TFT 601 and a constant current source 602. In this example, the buffer TFT is an n-channel TFT but may be a p-channel TFT instead. When an n-channel TFT is used, the output electric potential of the source follower circuit is lower than the input electric potential by Vgs of the TFT. On the other hand, when a p-channel TFT is used, the output electric potential of the source follower circuit is higher than the input electric potential by Vgs of the TFT. Although the source follower circuit has this problem, it also has an advantage of having a simpler structure than CMOS. In the case where a unipolar process is employed in order to reduce the number of steps in manufacturing a TFT, it is difficult to build an operation amplifier type analog buffer circuit and therefore a source follower type is chosen.

[Embodiment 4]

Figure 11:
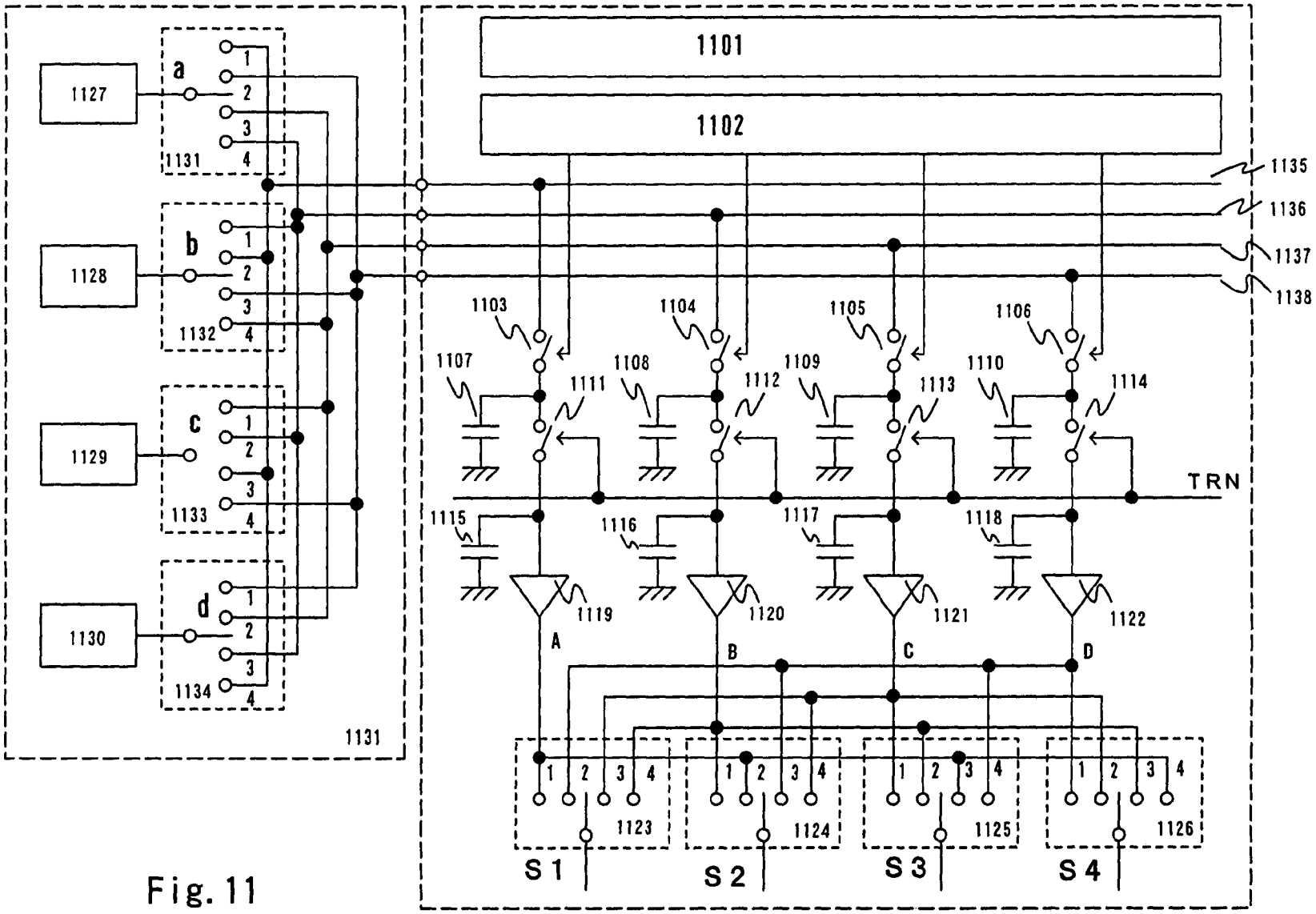
FIG. 11 is a diagram showing video signal switching in the liquid crystal display device of the present invention.

FIG. 11 shows an example in which a circuit for switching video signals to be inputted to a source signal line driver circuit is placed outside of the source signal line driver circuit in order to use a circuit of the present invention. When switching of source signal lines is made in accordance with the present invention solely between analog switches and source signal lines, output fluctuation is reduced but analog buffer output is sent to four source signal lines, which make it impossible to obtain a normal image. Therefore, signals are switched before inputted to the analog buffer circuits and again switched by switches that are placed downstream of the analog buffer circuits. In this way, a normal image is formed.

As in Embodiment Mode of the present invention, a case where switching is made each time a new frame is considered. In the first frame, an output of a video circuit 1127 is connected to a video signal line 1135 by connecting a switch 1131 to "1". A signal of the video signal line 1135 is inputted to an analog buffer circuit 1119 through switches 1103 and 1111. A switch 1123 is connected to "1" in the first frame and therefore an output of the analog buffer circuit 1119 is connected to a source signal line S1. Similarly, outputs of video circuits 1128, 1129, and 1130 are connected to source signal lines S2, S3, and S4, respectively.

In the second frame, an output of a video circuit 1127 is connected to a video signal line 1136 by connecting a switch 1132 to "2". A signal of the video signal line 1136 is inputted to an analog buffer circuit 1120 through switches 1104 and 1112. A switch 1124 is connected to "2" in the second frame and therefore an output of the analog buffer circuit 1120 is connected to a source signal line S1. Similarly, outputs of video circuits 1128, 1129, and 1130 are connected to source signal lines S2, S3 and S4, respectively.

In the third frame, an output of a video circuit 1127 is connected to a video signal line 1137 by connecting a switch 1133 to "3". A signal of the video signal line 1137 is inputted to an analog buffer circuit 1121 through switches 1105 and 1113. A switch 1125 is connected to "3" in the third frame and therefore an output of the analog buffer circuit 1121 is connected to a source signal line S1. Similarly, outputs of video circuits 1128, 1129, and 1130 are connected to source signal lines S2, S3, and S4, respectively.

In the fourth frame, an output of a video circuit 1127 is connected to a video signal line 1138 by connecting a switch 1134 to "4". A signal of the video signal line 1138 is inputted to an analog buffer circuit 1122 through switches 1106 and 1114. A switch 1126 is connected to "4" in the fourth frame and therefore an output of the analog buffer circuit 1122 is connected to a source signal line S1. Similarly, outputs of video circuits 1128, 1129, and 1130 are connected to source signal lines S2, S3, and S4, respectively.

In this way, the output of the video circuit 1127 is connected to the source signal line S1 in each frame. This makes it possible to switch analog buffer circuits from one to another each time a new frame is started while obtaining a normal image. Similarly, in any frame, the outputs of the video circuits 1128, 1129, and 1130 are connected to the source signal lines S2, S3, and S4, respectively.

Such circuits can be obtained by placing a substrate (printed board or flexible substrate) outside of a TFT substrate, or by bonding an LSI chip to the top face of a TFT substrate, or by using TFTs to form the video switching circuit and the pixel portion on the same substrate.

[Embodiment 5]

Figure 12:
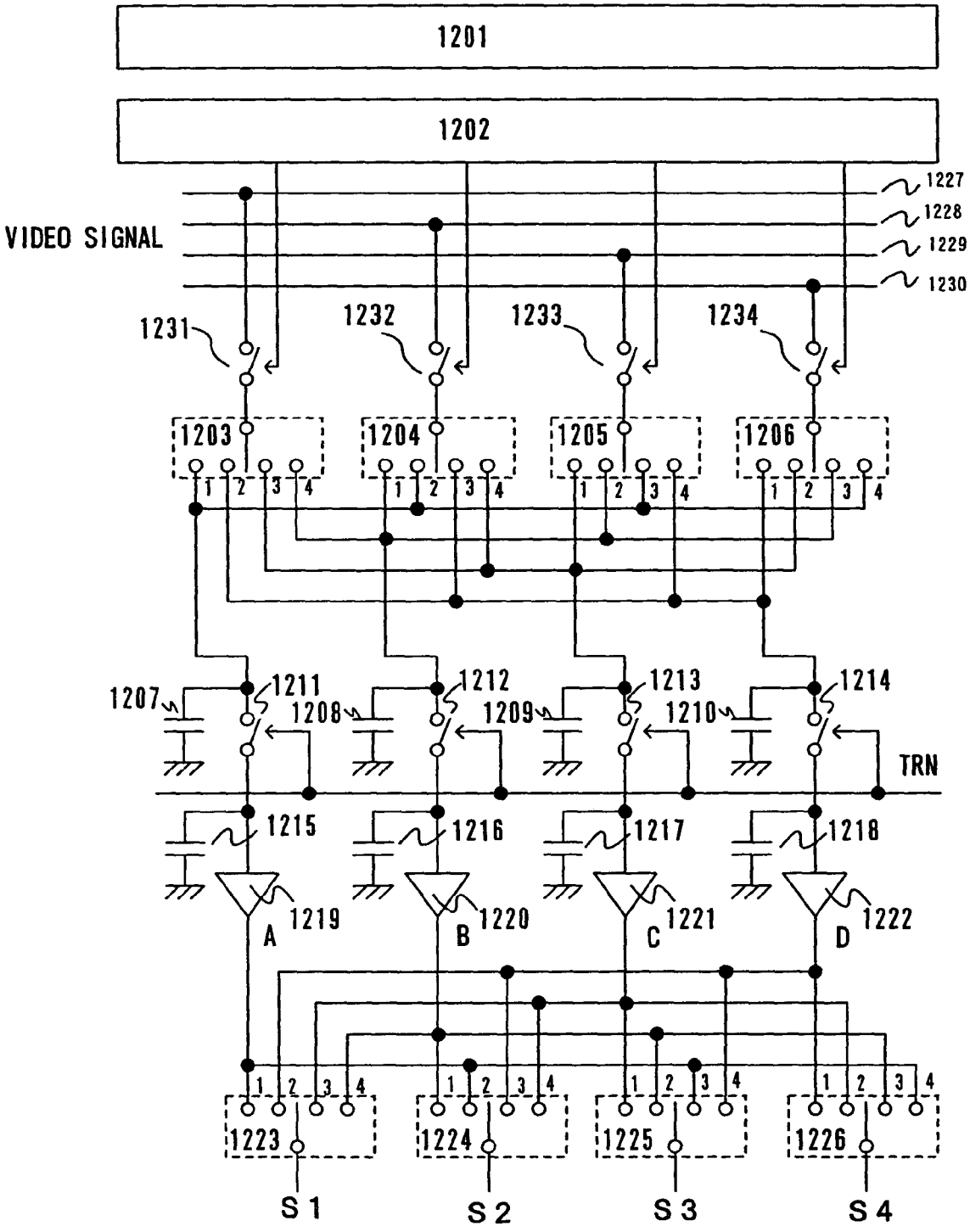
FIG. 12 is a diagram showing the video signal switching in the liquid crystal display device of the present invention.

This embodiment describes an example of incorporating a switching circuit in a source signal line driver circuit. In this embodiment, a switching circuit is placed between analog buffer circuits and video signal lines as shown in FIG. 12.

As in Embodiment Mode of the present invention, a case where switching is made each new frame is considered. In the first frame, an output of a video signal line 1127 passes through a switch 1231 and is connected to an analog memory 1207 and a switch 1211 by connecting a switch 1203 to "1". A signal of the video signal line 1227 is inputted to an analog memory 1215 and an analog buffer circuit 1219 through the switch 1211. A switch 1223 is connected to "1" in the first frame and therefore an output of the analog buffer circuit 1219 is connected to a source signal line S1. Similarly, outputs of video signal lines 1228, 1229, and 1230 are connected to the source signal lines S2, S3, and S4, respectively.

Next, in the second frame, an output of a video signal line 1227 passes through a switch 1231 and is connected to an analog memory 1208 and a switch 1212 by connecting a switch 1204 to "2". A signal of the video signal line 1227 is inputted to an analog memory 1216 and an analog buffer circuit 1220 through the switch 1212. A switch 1224 is connected to "2" in the second frame and therefore an output of the analog buffer circuit 1220 is connected to a source signal line S1. Similarly, outputs of video signal lines 1228, 1229, and 1230 are connected to the source signal lines S2, S3, and S4, respectively.

Then, in the third frame, an output of a video signal line 1227 passes through a switch 1231 and is connected to an analog memory 1209 and a switch 1213 by connecting to a switch 1205 to "3". A signal of the video signal line 1227 is inputted to an analog memory 1217 and an analog buffer circuit 1221 through the switch 1213. A switch 1225 is connected to "3" in the third frame and therefore an output of the analog buffer circuit 1221 is connected to a source signal line S1. Similarly, outputs of video signal lines 1228, 1229, and 1230 are connected to the source signal lines S2, S3, and S4, respectively.

Then, in the fourth frame, an output of a video signal line 1227 passes through a switch 1231 and is connected to an analog memory 1210 and a switch 1214 by connecting to a switch 1206 to "4". A signal of the video signal line 1227 is inputted to an analog memory 1218 and an analog buffer circuit 1222 through the switch 1214. A switch 1226 is connected to "4" in the fourth frame and therefore an output of the analog buffer circuit 1222 is connected to a source signal line S1. Similarly, outputs of video signal lines 1228, 1229, and 1230 are connected to the source signal lines S2, S3, and S4, respectively.

In this way, the output of the video signal line 1227 is connected to the source signal line S1 in each frame. This makes it possible to switch analog buffer circuits from one to another each time a new frame is started while obtaining a normal image. Similarly, in any frame, the outputs of the video signal lines 1228, 1229, and 1230 are connected to the source signal lines S2, S3, and S4, respectively.

[Embodiment 6]

In Embodiment Mode and Embodiments 1 of the present invention, the switching of a switching means is made periodically in predetermined order. However, the switching does not always have to be made in fixed order. For instance, Embodiment Mode, where the source signal line S1 is sequentially connected to the analog buffer outputs A, D, C, and B in the first four frames and to A, D, C, and B in the next four frames to repeat it periodically, may be modified such that S1 is sequentially connected to A, D, C, and B in the first four frames and to B, D, A, and C in the next four frames, thereby setting up random order. In this case, the circuits shown in Embodiments 1 through 5 can be combined freely.

A display device of the present invention is not limited to the source signal line driver circuit structure of this embodiment and any known source signal line driver circuit structure can be employed.

[Embodiment 7]

Figure 9:
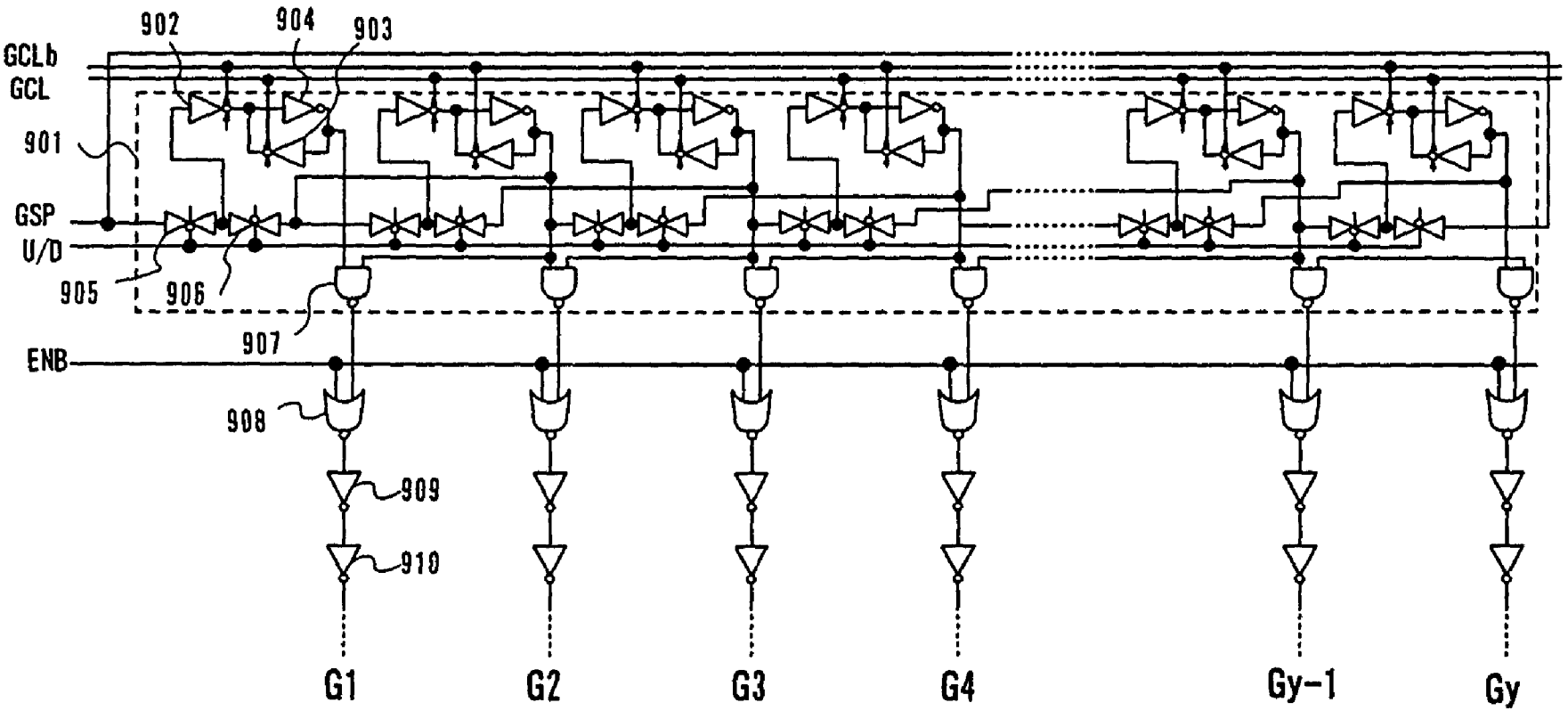
FIG. 9 is a circuit diagram of a gate signal line driver circuit of the present invention.

This embodiment describes with reference to FIG. 9 an example of the structure of a gate signal line driver circuit in a display device of the present invention.

The gate signal line driver circuit is composed of a shift register, a scanning direction switching circuit, and other components. Though not shown in the drawing, a level shifter, a buffer, and the like may be added as needed.

The shift register receives a start pulse GSP, a clock pulse GCL, and others and outputs a gate signal line selecting signal.

The shift register, which is denoted by 901, is composed of clocked inverters 902 and 903, an inverter 904, and a NAND 907. A start pulse GSP is inputted to the shift register 901, and a clock pulse GCL and an inverted clock pulse GCLb, which is obtained by inverting the polarity of GCL, turn the clocked inverters 902 and 903 conductive and unconductive. Sampling pulses are thus outputted from the NAND 907 sequentially.

The scanning direction switching circuit is composed of switches 905 and 906, and switches the operation direction of the shift register to left and right toward the drawing. When a scanning direction switching signal U/D is a Lo signal, the shift register outputs sampling pulses sequentially from left to right in FIG. 9. On the other hand, when a scanning direction switching signal U/D is a Hi signal, the shift register outputs sampling pulses sequentially from right to left toward the drawing.

Sampling pulses outputted from the shift register are inputted to a NOR 908 and put into calculation with enable signals ENB. The purpose of this computing is to avoid an error of selecting adjacent gate signal lines simultaneously which is caused by dulled sampling pulses. Signals outputted from the NOR 908 are outputted to gate signal lines G1 to Gy through buffers 909 and 910.

A start pulse GSP, a clock pulse GCL, and others that the shift register receives are inputted from an external timing controller.

A display device of the present invention is not limited to the gate signal line driver circuit structure of this embodiment and can employ any known gate signal line driver circuit structure freely. This embodiment can be combined with other embodiments of the present invention.

[Embodiment 8]

Figure 15:
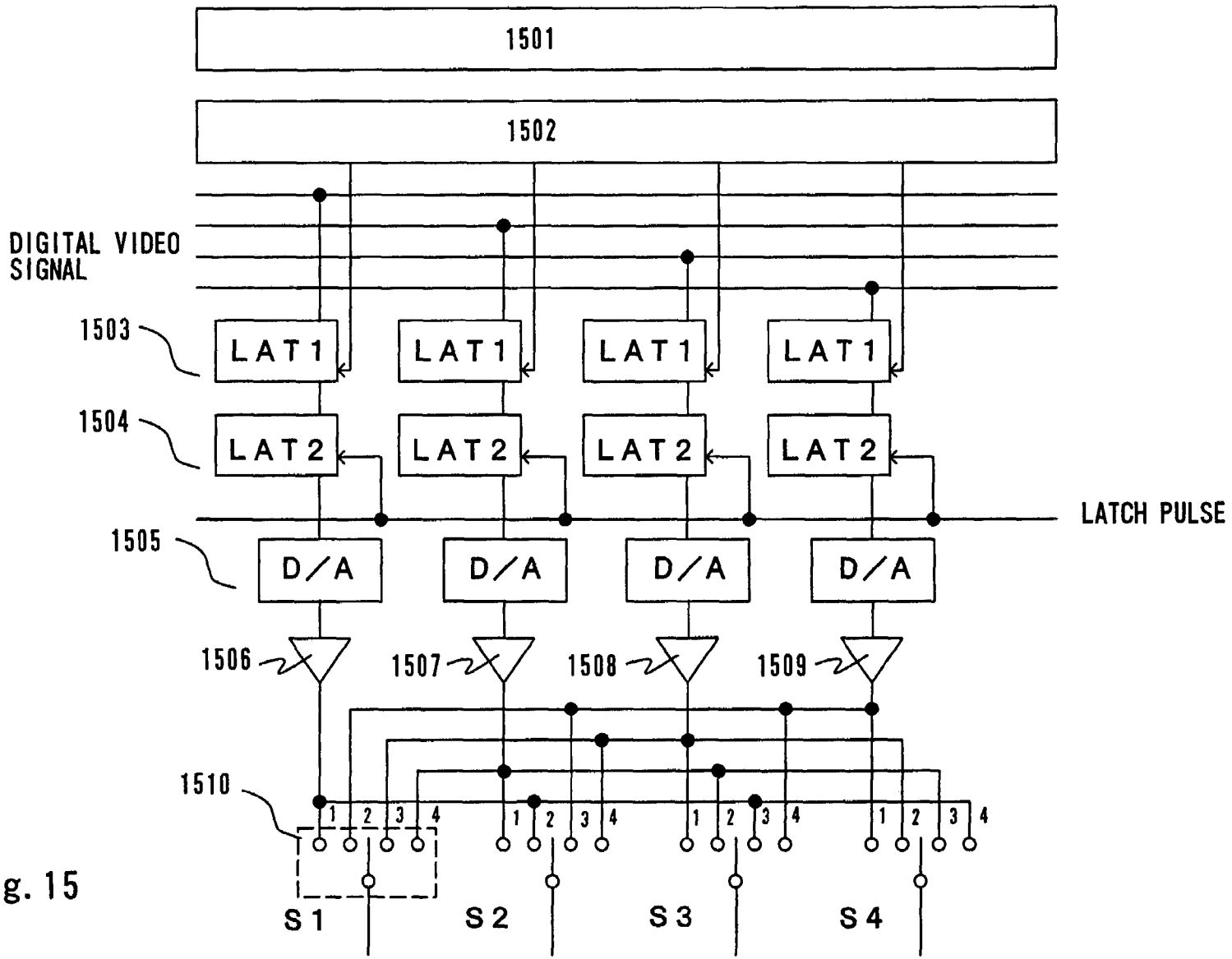
FIG. 15 is a block diagram of a digital source signal line driver circuit to which the present invention is applied.

FIG. 15 shows an example of a digital input source signal line driver circuit. Output of a shift register 1501 is inputted to a latch circuit 1503 through a buffer circuit 1502. The latch circuit has a function of taking in and storing a digital video signal when output of the buffer circuit becomes active. During one line period, the shift register takes in digital video signals as need arises and one line of digital data are stored.

After storing one line of data is finished, latch pulses are inputted in the retrace period and the data in the latch circuit 1503 are sent to a latch circuit 1504.

The data in the latch circuit 1504 are held until the next retrace period. While kept in the latch circuit 1504, the data receive analog conversion by a D/A converter 1505. Output of the D/A converter is used to drive source signal lines through an analog buffer circuit 1506 and a switch 1510. This embodiment can be combined with other embodiments of the present invention.

The switch circuit 1510 operates in the same way as the switch does in Embodiment Mode, and connects a source signal line S1 to the analog buffer circuit 1506 in the first frame, to an analog buffer circuit 1509 in the second frame, to an analog buffer circuit 1508 in the third frame, and to an analog buffer circuit 1507 in the fourth frame. In this way, output fluctuation of the analog buffer circuits is averaged as in Embodiment Mode. Display unevenness is thus reduced and the image quality is improved. This embodiment can be combined with other embodiments of the present invention.

[Embodiment 9]

Figure 16A:
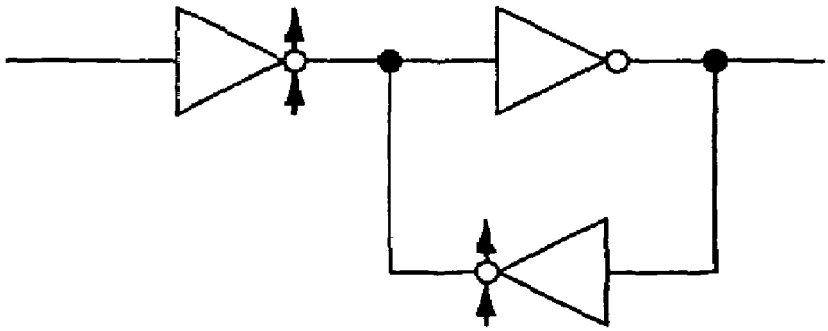
FIGS. 16A to 16C are circuit diagrams of latch circuits in the digital source signal line driver circuit.
Figure 16B:
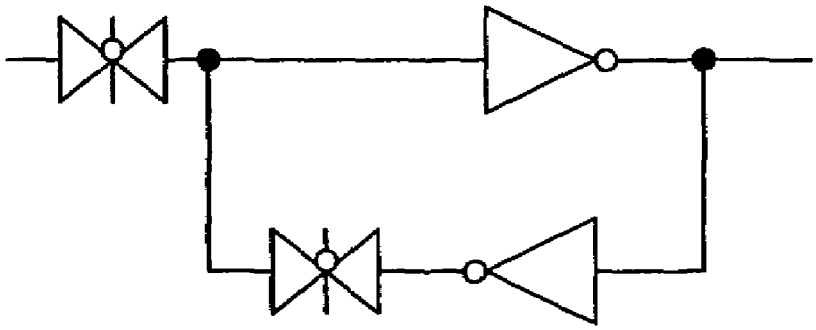
Figure 16C:
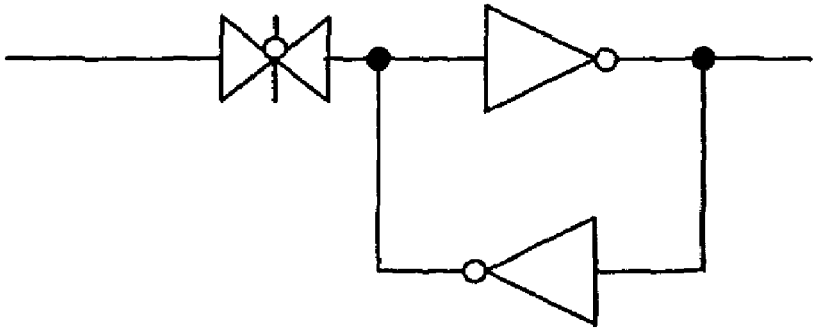

FIGS. 16A to 16C show specific examples of the latch circuits shown in Embodiment 8. The latch circuit in FIG. 16A uses a clocked inverter and is also employed in the shift register of the signal line driver circuit described above. The latch circuit in FIG. 16B is a combination of inverters and analog switches. The latch circuit in FIG. 16C is obtained by removing one analog switch from FIG. 16B. Of the two inverter circuits in FIG. 16C, the one whose output is connected to the analog switch is designed to have a less drive performance than that of the analog switch, so that the memory state can be changed by operating the analog switch. Any of these latch circuits is employable. Further, circuits other than those shown here may be employed. This embodiment can be combined with other embodiments of the present invention.

[Embodiment 10]

Figure 13:
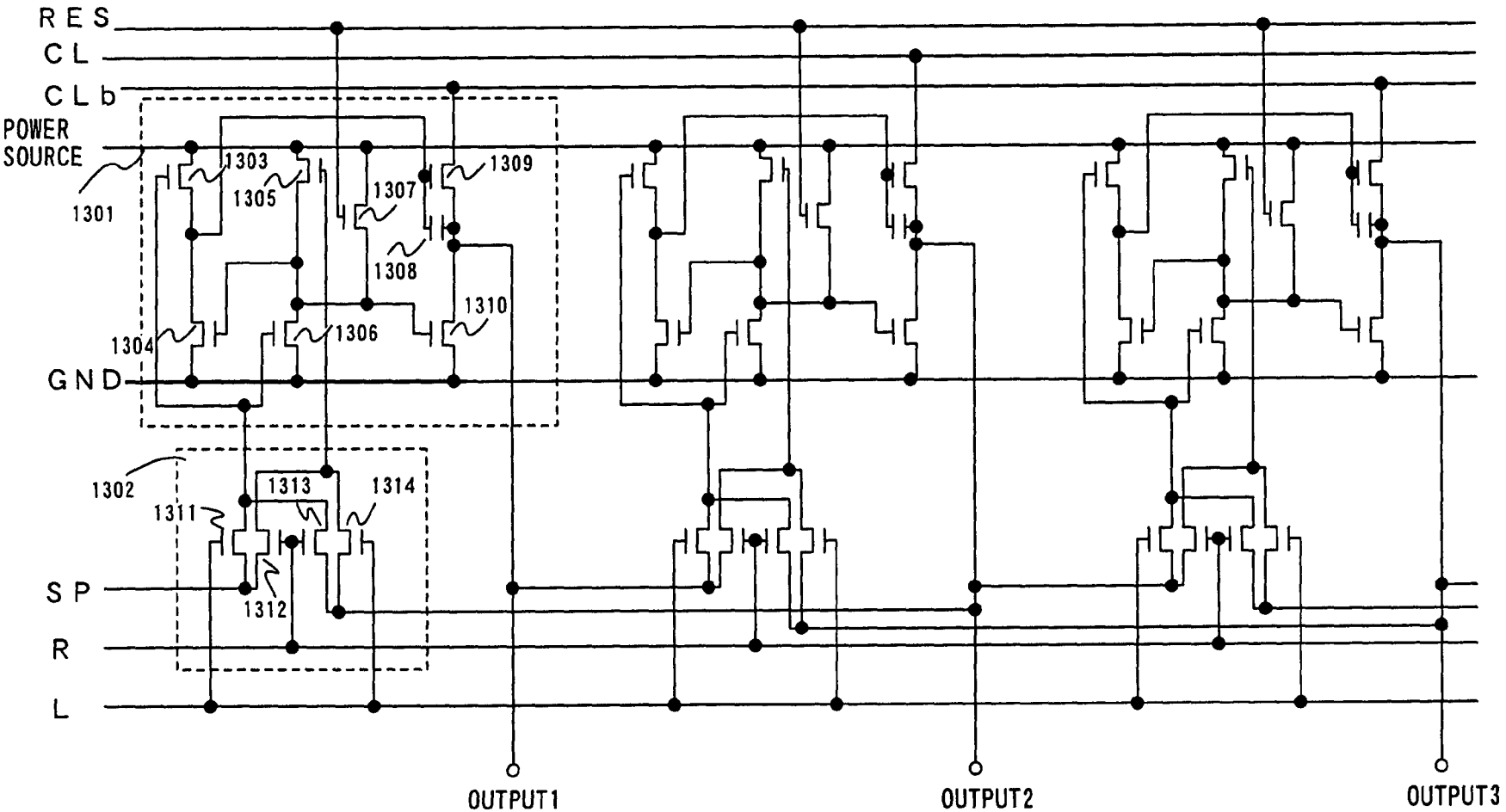
FIG. 13 is a circuit diagram of a shift register that uses unipolar transistors.

FIG. 13 shows an example of using unipolar TFTs to build a shift register. The example shown in FIG. 13 uses n-channel TFTs. P-channel unipolar TFTs may be used instead of n-channel TFTs. The use of unipolar process makes it possible to reduce the number of masks.

In FIG. 13, a start pulse is inputted to a scanning direction switching switch 1302, and through a switching TFT 1311, inputted to a shift register 1301. The shift register 1301 is a set reset type shift register which uses boot strap. The operation of the shift register 1301 will be described below.

A start pulse is inputted to a gate of a TFT 1303 and a gate of a TFT 1306. As the TFT 1306 is turned ON, a gate of a TFT 1304 is set to Lo turning the TFT 1304 OFF. A gate of a TFT 1310 is also set to Lo to turn the TFT 1310 OFF. The electric potential of the gate of the TFT 1303 is raised to the level of the power supply electric potential. Therefore, the electric potential of a gate of the TFT 1309 is first raised to the level of power supply electric potential —Vgs. Since the initial electric potential of an output 1 is Lo, the TFT 1309 raises the source electric potential while charging the output 1 and a capacitor 1308. When the gate of the TFT 1309 reaches power supply electric potential —Vgs), the TFT 1309 is still ON to cause the output 1 to continue its rise in electric potential. The gate of the TFT 1309 has no electric discharge path and therefore continues to rise in electric potential along with its source past the power supply electric potential.

As a drain of the TFT 1309 and the source thereof reach the same electric potential, the current flow to the output is stopped to stop the rise in electric potential of the TFT 1309. The output 1 thus can output Hi electric potential equal to the power supply electric potential. At this point, the electric potential of CLb is set to Hi. When CLb is dropped to Lo, electric charges in the capacitor 1308 are sent to CLb through the TFT 1309 to drop the output 1 to Lo. Pulses of the output 1 are transferred to the shift register of the next stage. The above is the operation of the circuit of Embodiment 10. This embodiment can be combined with other embodiments of the present invention.

[Embodiment 11]

Figure 14:
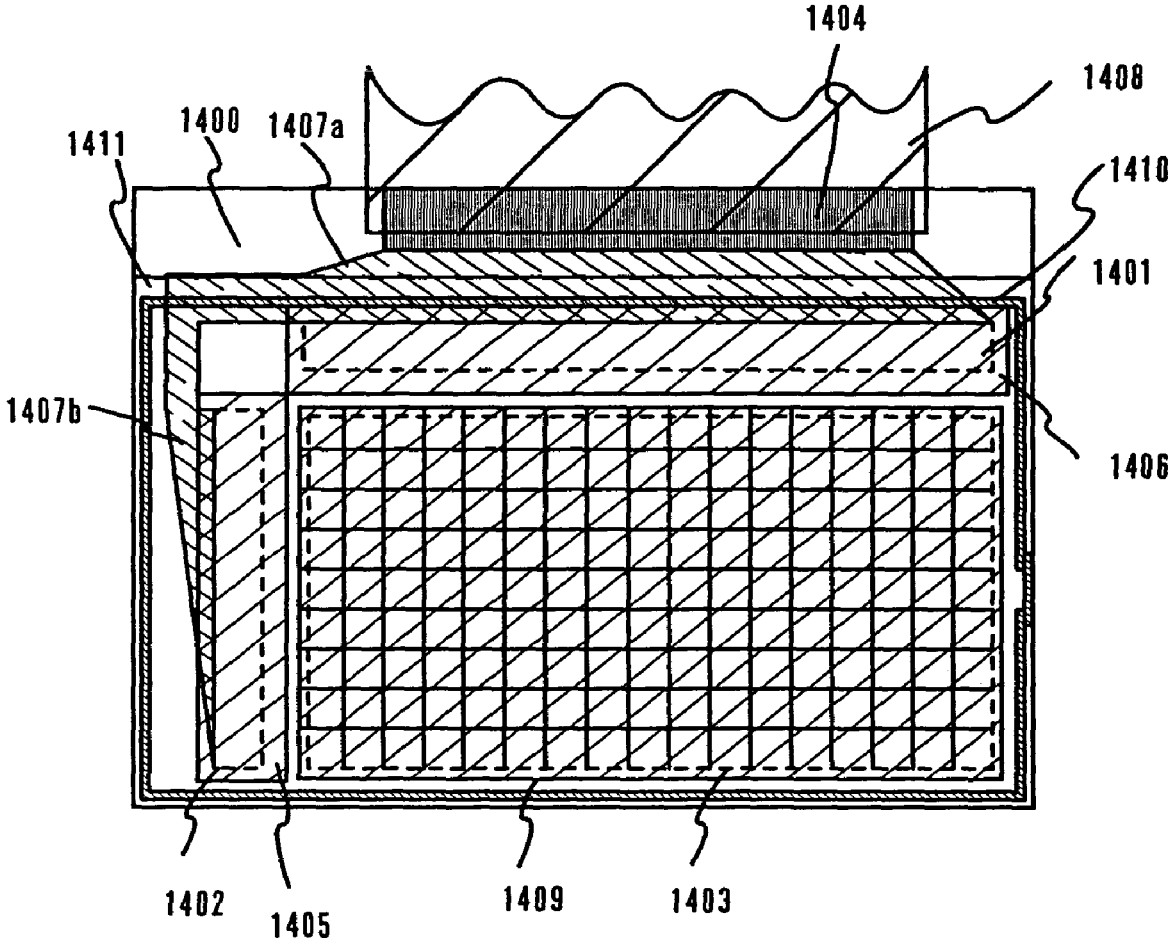
FIG. 14 is an exterior view of the liquid crystal display device of the present invention.

FIG. 14 is a top view of a liquid crystal display device of the present invention. In FIG. 14, an active matrix substrate has a pixel portion 1403, a source signal line driver circuit 1401, a gate signal line driver circuit 1402, an external input terminal 1404 to which an FPC terminal 1408 is bonded, wires 1407*a* and 1407*b* for connecting the external input terminal to an input portion of each circuit, etc. The active matrix substrate is bonded to an opposite substrate 1411, which has a color filter and other components, with a seal member 1410 interposed between the two substrates.

A light-shielding layer 1405 is provided on the opposite substrate side so as to overlap the source signal line driver circuit 1401. A light-shielding layer 1406 is formed on the opposite substrate side so as to overlap the gate signal line driver circuit 1402. A color filter 1409 is provided on the opposite substrate side above the pixel portion 1403, and is composed of a light-shielding layer and colored layers of three colors, red (R), green (G), and blue (B) according to each pixel. In actual display, a red (R) colored layer, a green (G) colored layer, and a blue (B) colored layer form a full color image. The colored layers of the three colors are arranged arbitrarily.

Although the color filter 1409 is placed on the opposite substrate here in order to obtain a color image, there is no particular limitation. The color filter may be formed on the active matrix substrate during manufacture of the active matrix substrate.

In the color filter, a light-shielding layer is provided between adjacent pixels in order to shield portions other than the display region against light. The light-shielding layers 1405 and 1406 in the regions that cover the driver circuits may be omitted since the regions covering the driver circuits are covered when the liquid crystal display device is installed as a display portion in electronic equipment. Alternatively, the active matrix substrate may be provided with a light-shielding layer during manufacture of the active matrix substrate.

It is also possible to shield the portions other than the display region (gaps between pixel electrodes) and the driver circuits against light without using the above light-shielding layers. In this case, the plural colored layers that constitute the color filter are stacked and suitably arranged between the opposite substrate and the opposite electrode so as to shield those regions against light.

The liquid crystal display device is thus completed. This embodiment shows a method of manufacturing an active matrix liquid crystal display device of transmissive type but an active matrix liquid crystal display device of reflective type can be manufactured by a similar method. This embodiment can be combined with other embodiments of the present invention.

[Embodiment 12]

A liquid crystal display device manufactured as above can constitute a liquid crystal module and can be used as a display portion of various electronic equipment. Given below is a description on electronic equipment in which a liquid crystal display device manufactured in accordance with the present invention is incorporated as a display medium.

As examples of such electronic equipment, video cameras, digital cameras, goggle type displays (head mounted displays), navigation systems, audio playback devices (car audios, audio components, etc.), notebook type personal computers, game machines, portable information terminals (mobile computers, mobile telephones, mobile type game machines, and electronic books, etc.), image reproduction devices equipped with a recording medium (specifically, devices equipped with a display device capable of reproducing the recording medium such as a digital versatile disk (DVD), etc. and displaying the image thereof), and the like can be given. Examples of these electronic equipment are shown in FIG. 17.

Figure 17A:
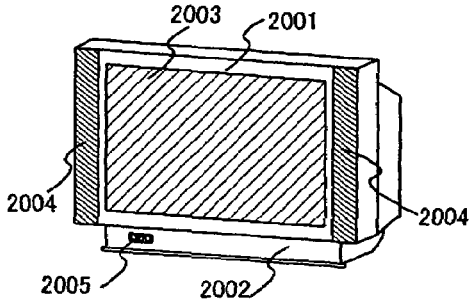
FIGS. 17A to 17H are diagrams of electronic equipment using the liquid crystal display device of the present invention.

FIG. 17A is a display device, which is composed of a frame 2001, a support base 2002, a display portion 2003, a speaker portion 2004, a video input terminal 2005, and the like. The light emitting device manufactured according to the present invention is used for the display portion 2003 to manufacture the display device. As the light emitting device having a light emitting element is a self-luminous type, there is no need for a backlight, whereby it is possible to obtain a thinner display portion than that of a liquid crystal display device. Note that the term display device includes all display devices for displaying information, such as those for personal computers, those for receiving TV broadcasting, and those for advertising.

Figure 17B:
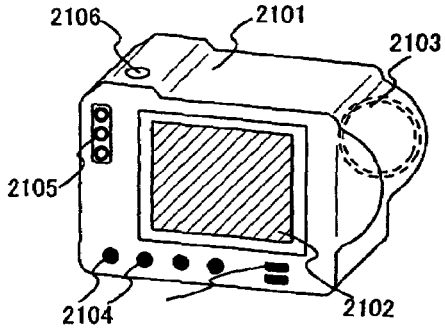

FIG. 17B is a digital still camera, which is composed of a main body 2101, a display portion 2102, an image-receiving portion 2103, operation keys 2104, an external connection port 2105, a shutter 2106, and the like. The light emitting device manufactured according to the present invention is used for the display portion 2102 to manufacture the digital still camera.

Figure 17C:
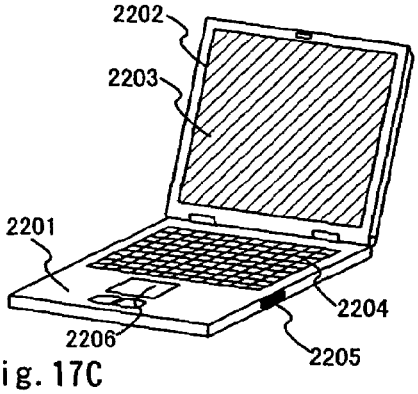

FIG. 17C is a notebook type personal computer, which is composed of a main body 2201, a frame 2202, a display portion 2203, a keyboard 2204, an external connection port 2205, a pointing mouse 2206, and the like. The light emitting device manufactured according to the present invention is used for the display portion 2203 to manufacture the notebook type personal computer.

Figure 17D:
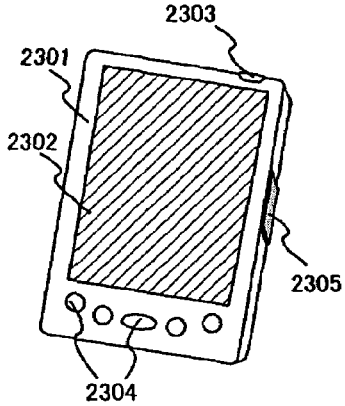

FIG. 17D is a mobile computer, which is composed of a main body 2301, a display portion 2302, a switch 2303, operation keys 2304, an infrared port 2305, and the like. The light emitting device manufactured by the present invention is used for the display portion 2302 to manufacture the mobile computer.

Figure 17E:
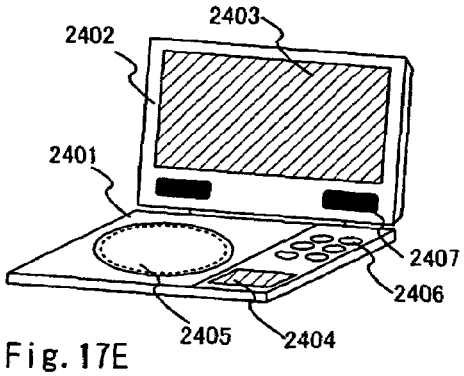

FIG. 17E is a portable image reproduction device provided with a recording medium (specifically, a DVD playback device), which is composed of a main body 2401, a frame 2402, a display portion A 2403, a display portion B 2404, a recording medium (such as a DVD) read-in portion 2405, operation keys 2406, a speaker portion 2407, and the like. The display portion A 2403 mainly displays image information, and the display portion B 2404 mainly displays character information, and the light emitting device manufactured according to the present invention can be used in the display portion A 2403 and in the display portion B 2404 to manufacture the portable image reproduction device. Note that image reproduction devices provided with a recording medium include game machines for domestic use and the like.

Figure 17F:
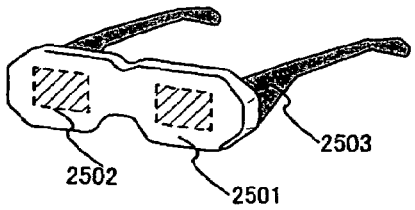

FIG. 17F is a goggle type display (head mounted display) which is composed of a main body 2501, a display portion 2502, an arm 2503, and the like. The light emitting device manufactured according to the present invention can be used in the display portion 2502 to manufacture the goggle type display.

Figure 17G:
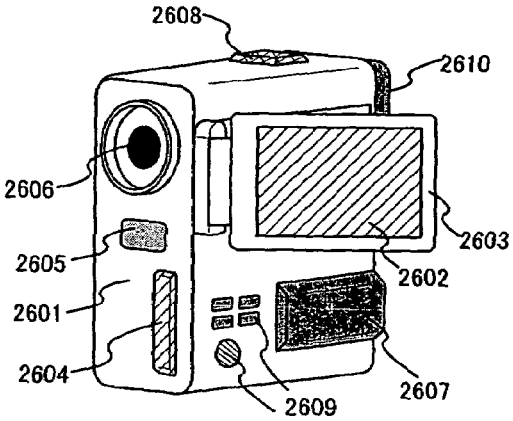

FIG. 17G is a video camera, which is composed of a main body 2601, a display portion 2602, a frame 2603, an external connection port 2604, a remote control receiving portion 2605, an image receiving portion 2606, a battery 2607, an audio input portion 2608, operation keys 2609, an eyepiece portion 2610, and the like. The light emitting device manufactured according to the present invention is used for the display portion 2602 to manufacture the video camera.

Figure 17H:
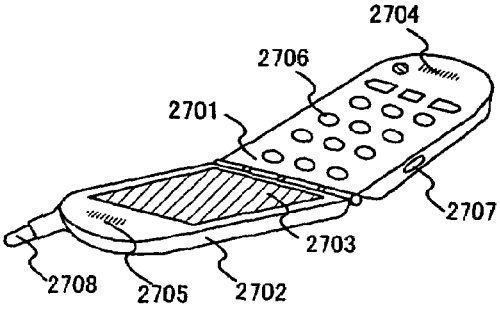

FIG. 17H is a mobile telephone, which is composed of a main body 2701, a frame 2702, a display portion 2703, an audio input portion 2704, an audio output portion 2705, operation keys 2706, an external connection port 2707, an antenna 2708, and the like. The light emitting device manufactured according to the present invention is used for the display portion 2703 to manufacture the mobile telephone. Note that by displaying white characters on a black background, the display portion 2703 can suppress the power consumption of the mobile telephone.

As described above, the application scope of the light emitting device manufactured in accordance with a manufacturing method of the present invention is so wide that the light emitting device of the present invention can be used in electronic equipment of any field. Further, the electronic equipment of this embodiment can be achieved with any construction made by combining Embodiments 1 to 4.

Conventional liquid crystal display devices that use analog buffer circuits for outputs have a problem of vertical streaks which are caused by fluctuation among the analog buffer circuits and which lower the image quality.

According to the present invention, outputs of analog buffer circuits are periodically switched from one to another to average the output voltage fluctuation and the fluctuation in output is thus reduced.

What is claimed is:

1. A liquid crystal display device having on an insulating substrate a plurality of source signal lines, a plurality of gate signal lines, a plurality of pixels, and a source signal line driver circuit for driving the source signal lines, wherein the source signal line driver circuit has a plurality of analog buffer circuits, wherein a switching circuit having switches is provided between the analog buffer circuits and the source signal lines, wherein the plurality of source signal lines and the plurality of analog buffer circuits constitute a circuit group, wherein a connection between one of the source signal lines and one of the analog buffer circuits is periodically switched to a connection between the one of the source signal lines and another one of the analog buffer circuits by any one of the switches, wherein a set of n periods is periodically repeated, and wherein, in an r-th period (r is a natural that satifies $1 \leqq r \leqq n$), the switching circuit connects an m-th source signal line (m is a natural number that satifies $1 \leqq m \leqq n-r+1$) in the circuit group to an $(m+r-1)$-th analog buffer circuit and an 1-th source signal line (l is a natural number that satifies $n-r+2 \leqq 1 \leqq n$) to an $(1-n+r-1)$-th analog buffer circuit, respectively.

2. A liquid crystal display device according to claim 1, wherein the analog buffer circuits are source follower circuits.

3. A liquid crystal display device according to claim 1, wherein the analog buffer circuits are voltage follower circuits.

4. An electronic equipment comprising a liquid crystal display device according to claim 1.

5. A liquid crystal display device according to claim 1, wherein the switching circuit comprises an analog switching circuit.

6. A liquid crystal display device according to claim 1, wherein a first source signal line is connected to a first analog buffer circuit via a first connection point of one of the switches in a first period, and the first source signal line is connected to a second analog buffer circuit via a second connection point of the one of the switches in a second period.

7. A liquid crystal display device having on an insulating substrate a plurality of source signal lines, a plurality of gate signal lines, a plurality of pixels, and a source signal line driver circuit for driving the signal lines, wherein the source signal line driver circuit has a plurality of analog buffer circuits, wherein a switching circuit having switches is provided between the analog buffer circuits and the source signal lines, wherein the plurality of source signal lines and the plurality of analog buffer circuits constitute a circuit group, wherein a connection between one of the source signal lines and one of the analog buffer circuits is switched to a connection between the one of the source signal lines and another one of the analog buffer circuits in a random timing by any one of the switches, wherein a set of n periods is repeated in a random timing, and wherein, in an r-th period (r is a natural number that satifies $1 \leqq r \leqq n$), the switching circuit connects an m-th source signal line (m is a natural number that satifies $1 \leqq m \leqq n-r+1$) in the circuit group to an $(m+r-1)$-th analog buffer circuit and an 1-th source signal line (l is a natural number that satifies $n-r+2 \leqq 1 \leqq n$) to an $(1-n+r-1)$-th analog buffer circuit, respectively.

8. A liquid crystal display device according to claim 7, wherein the analog buffer circuits are source follower circuits.

9. A liquid crystal display device according to claim 7, wherein the analog buffer circuits are source follower circuits.

10. An electronic equipment comprising a liquid crystal display device according to claim 7.

11. A liquid crystal display device according to claim 7, wherein the switching circuit comprises an analog switching circuit.

12. A liquid crystal display device according to claim 7, wherein a first source signal line is connected to a first analog buffer circuit via a first connection point of one of the switches in a first period, and the first source signal line is connected to a second analog buffer circuit via a second connection point of the one of the switches in a second period.

13. A liquid crystal display device having on an insulating substrate a plurality of pixels, a plurality of source signal lines, a plurality of gate signal lines, and a source signal line driver circuit, the source signal line driver circuit having a plurality of analog buffer circuits to drive the source signal lines, wherein a switching circuit having switches is provided between the analog buffer circuits and the source signal lines, wherein n (n is a natural number and is equal to or larger than 2) source signal lines and n analog buffer circuits constitute a circuit group, wherein a set of n periods is periodically repeated, wherein a connection between one of the source signal lines and one of the analog buffer circuits is switched to a connection between the one of the source signal lines and another one of the analog buffer circuits in every period by any one of the switches, and wherein, in an r-th period (r is a natural number that satisfies $1 \leqq r \leqq n$), the switching circuit connects an m-th source signal line (m is a natural number that satisfies $1 \leqq m \leqq n-r+1$) in the circuit group to an (m+r−1)-th analog buffer circuit and an 1-th source signal line (l is a natural number that satisfies $n-r+2 \leqq 1 \leqq n$) to an $(1 \leqq n+r-1)$-th analog buffer circuit, respectively,

14. A liquid crystal display device according to claim 13, wherein the analog buffer circuits are source follower circuits.

15. A liquid crystal display device according to claim 13, wherein the analog buffer circuits are source follower circuits.

16. An electronic equipment comprising a liquid crystal display device according to claim 13.

17. A liquid crystal display device according to claim 13, wherein the switching circuit comprises an analog switching circuit.

18. A liquid crystal display device according to claim 13, wherein a first source signal line is connected to a first analog buffer circuit via a first connection point of one of the switches in a first period, and the first source signal line is connected to a second analog buffer circuit via a second connection point of the one of the switches in a second period.

19. A liquid crystal display device having on an insulating substrate a plurality of pixels, a plurality of source signal lines, a plurality of gate signal lines, and a source signal line driver circuit, the source signal line driver circuit having a plurality of analog buffer circuits to drive the source signal lines, wherein a switching circuit having switches is provided between the analog buffer circuits and the source signal lines, wherein n (n is a natural number and is equal to or larger than 2) source signal lines and n analog buffer circuits constitute a circuit group, wherein a set of n periods is repeated in a random timing, and wherein a connection between one of the source signal lines and one of the analog buffer circuits is switched to a connection between the one of the source signal lines and another one of the analog buffer circuits in every period by any one of the switches, and wherein, in an r-th period (r is a natural number that satisfies $1 \leqq r \leqq n$), the switching circuit connects an m-th source signal line (m is a natural number that satifies $1 \leqq m \leqq n-r+1$) in the circuit group to an(m+r−1)-th analog buffer circuit and an 1-th source signal line (1 is a natural number that satifies $n-r+2 \leqq 1 \leqq n$) to an (1−n+r−1)-th analog buffer circuit, respectively.

20. A liquid crystal display device according to claim 19, wherein the analog buffer circuits are source follower circuits.

21. A liquid crystal display device according to claim 19, wherein the analog buffer circuits are source follower circuits.

22. An electronic equipment comprising a liquid crystal display device according to claim 19.

23. A liquid crystal display device according to claim 19, wherein the switching circuit comprises an analog switching circuit.

24. A liquid crystal display device according to claim 19, wherein a first source signal line is connected to a first analog buffer circuit via a first connection point of one of the switches in a first period, and the first source signal line is connected to a second analog buffer circuit via a second connection point of the one of the switches in a second period.

25. A liquid crystal display device having on an insulating substrate a plurality of pixels, a plurality of source signal lines, a plurality of gate signal lines, and a source signal line driver circuit, the source signal line driver circuit having analog buffer circuits to drive the source signal lines, wherein a switching circuit is provided between the analog buffer circuits and the source signal lines, wherein n (n is a natural number and is equal to or larger than 2) source signal lines and n analog buffer circuits constitute a circuit group, wherein a set of n periods is periodically repeated, and wherein, in an r-th period (r is a natural number that satisfies $1 \leqq r \leqq n$), the switching circuit connects an m-th source signal line (m is a natural number that satisfies $1 \leqq m \leqq n-r+1$) in the circuit group to an (m+r−1)-th analog buffer circuit and an l-th source signal line (l is a natural number that satisfies $n-r+2 \leqq l \leqq n$) to an (l−n+r−1)-th analog buffer circuit, respectively.

26. A liquid crystal display device according to claim 25, wherein the analog buffer circuits are source follower circuits.

27. A liquid crystal display device according to claim 25, wherein the analog buffer circuits are source follower circuits.

28. An electronic equipment comprising a liquid crystal display device according to claim 25.

29. A liquid crystal display device according to claim 25, wherein the switching circuit comprises an analog switching circuit.

30. A liquid crystal display device according to claim 25, wherein a first source signal line is connected to a first analog buffer circuit via a first connection point of a first switch of the switching circuit in a first period, and the first source signal line is connected to a second analog buffer circuit via a second connection point of the first switch of the switching circuit in a second period.

31. A liquid crystal display device having on an insulating substrate a plurality of pixels, a plurality of source signal lines, a plurality of gate signal lines, and a source signal line driver circuit, the source signal line driver circuit having analog buffer circuits to drive the source signal lines, wherein a switching circuit is provided between the analog buffer circuits and the source signal lines, wherein n (n is a natural number and is equal to or larger than 2) source signal lines and n analog buffer circuits constitute a circuit group, wherein a set of n periods is repeated in a random timing, and wherein, in an r-th period (r is a natural number that satisfies $1 \leqq r \leqq n$), the switching circuit connects an m-th source signal line (m is a natural number that satisfies $1 \leqq m \leqq n-r+1$) in the circuit group to an (m+r−

1)-th analog buffer circuit and an l-th source signal line (l is a natural number that satisfies $n-r+2 \leqq l \leqq n$) to an $(l-n+r-1)$-th analog buffer circuit, respectively.

32. A liquid crystal display device according to claim 31, wherein the analog buffer circuits are source follower circuits.

33. A liquid crystal display device according to claim 31, wherein the analog buffer circuits are source follower circuits.

34. An electronic equipment comprising a liquid crystal display device according to claim 31.

35. A liquid crystal display device according to claim 31, wherein the switching circuit comprises an analog switching circuit.

36. A liquid crystal display device according to claim 31, wherein a first source signal line is connected to a first analog buffer circuit via a first connection point of a first switch of the switching circuit in a first period, and the first source signal line is connected to a second analog buffer circuit via a second connection point of the first switch of the switching circuit in a second period.

37. A method of driving a liquid crystal display device having on an insulating substrate a plurality of source signal lines, a plurality of gate signal lines, a plurality of pixels, a source signal line driver circuit for driving the source signal lines, and a switching circuit having switches, wherein the source signal line driver circuit has a plurality of analog buffer circuits, wherein the plurality of source signal lines and the plurality of analog buffer circuits constitute a circuit group, and wherein a connection between one of the source signal lines and one of the analog buffer circuits is periodically switched to a connection between the one of the source signal lines and another one of the analog buffer circuits by any one of the switches, wherein a set of n periods is periodically repeated, and wherein, in an r-th period (r is a natural number that satisfies $1 \leqq r \leqq n$), the switching circuit connects an m-th source signal line (m is a natural number that satisfies $1 \leqq m \leqq n-r+1$) in the circuit group to an $(m+r-1)$-th analog buffer circuit and an 1-th source signal line (1 is a natural number that satisfies $n-r+2 \leqq 1 \leqq n$) to an $(1-n+r-1)$-th analog buffer circuit, respectively.

38. A method of driving a liquid crystal display device according to claim 37, wherein the analog buffer circuits are source follower circuits.

39. A method of driving a liquid crystal display device according to claim 37, wherein the analog buffer circuits are voltage follower circuits.

40. A method of driving a liquid crystal display device according to claim 37, wherein a first source signal line is connected to a first analog buffer circuit via a first connection point of one of the switches in a first period, and the first source signal line is connected to a second analog buffer circuit via a second connection point of the one of the switches in a second period.

41. A method of driving a liquid crystal display device having on an insulating substrate a plurality of source signal lines, a plurality of gate signal lines, a plurality of pixels, a source signal line driver circuit for driving the source signal lines, and a switching circuit having switches, wherein the source signal line driver circuit has a plurality of analog buffer circuits, wherein the plurality of source signal lines and the plurality of analog buffer circuits constitute a circuit group, and wherein a connection between one of the source signal lines and one of the analog buffer circuits is switched to a connection between the one of the source signal lines and another one of the analog buffer circuits in a random timing by any one of the switches, wherein a set of n periods is repeated in a random timing, and wherein, in an r-th period (r is a natural number that satisfies $1 \leqq r \leqq n$), the switching circuit connects an m-th source signal line (m is a natural number that satisfies $1 \leqq m \leqq n-r+1$) in the circuit group to an $(m+r-1)$-th analog buffer circuit and an 1th source signal line (1 is a natural number that satisfies $n-r+2 \leqq 1 \leqq n$) to an $(1-n+r-1)$-th analog buffer circuit, respectively.

42. A method of driving a liquid crystal display device according to claim 41, wherein the analog buffer circuits are source follower circuits.

43. A method of driving a liquid crystal display device according to claim 41, wherein the analog buffer circuits are source follower circuits.

44. A method of driving a liquid crystal display device according to claim 41, wherein a first source signal line is connected to a first analog buffer circuit via a first connection point of one of the switches in a first period, and the first source signal line is connected to a second analog buffer circuit via a second connection point of the one of the switches in a second period.

45. A method of driving a liquid crystal display device having on an insulating substrate a plurality of pixels, a plurality of source signal lines, a plurality of gate signal lines, a source signal line driver circuit, the source signal line driver circuit having a plurality of analog buffer circuits to drive the source signal lines, and a switching circuit having switches, wherein n (n is a natural number and is equal to or larger than 2) source signal lines and n analog buffer circuits constitute a circuit group, wherein a set of n periods is periodically repeated, and wherein a connection between one of the source signal lines and one of the analog buffer circuits is switched to a connection between the one of the source signal lines and another one of the analog buffer circuits in every period by any one of the switches, and wherein, in an r-th period (r is a natural number that satisfies $1 \leqq r \leqq n$), the switching circuit connects an m-th source signal line (m is a natural number that satisfies $1 \leqq m \leqq n-r+1$) in the circuit group to an $(m+r-1)$-th analog buffer circuit and an 1-th source signal line (1 is a natural number that satisfies $n-r+2 \leqq 1 \leqq n$) to an $(1-n+r-1)$-th analog buffer circuit, respectively.

46. A method of driving a liquid crystal display device according to claim 45, wherein the analog buffer circuits are source follower circuits.

47. A method of driving a liquid crystal display device according to claim 45, wherein the analog buffer circuits are source follower circuits.

48. A method of driving a liquid crystal display device according to claim 45, wherein a first source signal line is connected to a first analog buffer circuit via a first connection point of one of the switches in a first period, and the first source signal line is connected to a second analog buffer circuit via a second connection point of the one of the switches in a second period.

49. A method of driving a liquid crystal display device having on an insulating substrate a plurality of pixels, a plurality of source signal lines, a plurality of gate signal lines, a source signal line driver circuit, the source signal line driver circuit having a plurality of analog buffer circuits to drive the source signal lines, and a switching circuit having switches, wherein n (n is a natural number and is equal to or larger than 2) source signal lines and n analog buffer circuits constitute a circuit group, wherein a set of n periods is repeated in a random timing, and wherein a connection between one of the source signal lines and one of the analog buffer circuits is switched to a connection between the one of the source signal lines and another one of the analog buffer circuits in every period by any one of the switches, and wherein, in an r-th period (r is a natural number that satisfies $1 \leqq m \leqq n-r+1$) in the circuit group to an (M+r−1)-th analog buffer circuit and an 1-th source signal line (1 is a natural number that satisfies $n-r+2 \leqq 1 \leqq n$) to an (1−n+r−1)-th analog buffer circuit, respectively.

50. A method of driving a liquid crystal display device according to claim 49, wherein the analog buffer circuits are source follower circuits.

51. A method of driving a liquid crystal display device according to claim 49, wherein the analog buffer circuits are source follower circuits.

52. A method of driving a liquid crystal display device according to claim 49, wherein a first source signal line is connected to a first analog buffer circuit via a first connection point of one of the switches in a first period, and the first source signal line is connected to a second analog buffer circuit via a second connection point of the switch in a second period.

53. A method of driving a liquid crystal display device having on an insulating substrate a plurality of pixels, a plurality of source signal lines, a plurality of gate signal lines, and a source signal line driver circuit, the source signal line driver circuit having analog buffer circuits to drive the source signal lines, wherein n (n is a natural number and is equal to or larger than 2) source signal lines and n analog buffer circuits constitute a circuit group, wherein a set of n periods is periodically repeated, and wherein, in an r-th period (r is a natural number that satisfies $1 \leqq r \leqq n$), an m-th source signal line (m is a natural number that satisfies $1 \leqq m \leqq n-r+1$) in the circuit group is driven by an (m+r−1)-th analog buffer circuit and an l-th source signal line (l is a natural number that satisfies $n-r+2 \leqq l \leqq n$) is driven by an ($l \leqq n+r-1$)-th analog buffer circuit.

54. A method of driving a liquid crystal display device according to claim 53, wherein the analog buffer circuits are source follower circuits.

55. A method of driving a liquid crystal display device according to claim 53, wherein a first source signal line is connected to a first analog buffer circuit via a first connection point of a switch in a first period, and the first source signal line is connected to a second analog buffer circuit via a second connection point of the switch in a second period.

56. A method of driving a liquid crystal display device according to claim 53, wherein a first source signal line is connected to a first analog buffer circuit via a first connection point of one of switches in a first period, and the first source signal line is connected to a second analog buffer circuit via a second connection point of the one of switches in a second period.

57. A method of driving a liquid crystal display device having on an insulating substrate a plurality of pixels, a plurality of source signal lines, a plurality of gate signal lines, and a source signal line driver circuit, the source signal line driver circuit having analog buffer circuits to drive the source signal lines, wherein n (n is a natural number and is equal to or larger than 2) source signal lines and n analog buffer circuits constitute a circuit group, wherein a set of n periods is repeated in a random timing, and wherein, in an r-th period (r is a natural number that satisfies $1 \leqq r \leqq n$), an m-th source signal line (m is a natural number that satisfies $1 \leqq m \leqq n-r+1$) in the circuit group is driven by an (m+r−1)-th analog buffer circuit and an l-th source signal line (l is a natural number that satisfies $n-r+2 \leqq l \leqq n$) is driven by an ($l \leqq n+r-1$)-th analog buffer circuit.

58. A method of driving a liquid crystal display device according to claim 57, wherein the analog buffer circuits are source follower circuits.

59. A method of driving a liquid crystal display device according to claim 57, wherein the analog buffer circuits are source follower circuits.

60. A method of driving a liquid crystal display device according to claim 57, wherein a first source signal line is connected to a first analog buffer circuit via a first connection point of a switch in a first period, and the first source signal line is connected to a second analog buffer circuit via a second connection point of the switch in a second period.

* * * * *